US007978995B2

(12) United States Patent
Isobe et al.

(10) Patent No.: US 7,978,995 B2
(45) Date of Patent: Jul. 12, 2011

(54) IMAGE FORMING APPARATUS FOR IMAGE DENSITY ADJUSTMENT

(75) Inventors: Akifumi Isobe, Hidaka (JP); Shigeo Ogino, Toyokawa (JP); Hiroyuki Watanabe, Hachioji (JP); Tadayuki Ueda, Kokubunji (JP); Yoshihito Sasamoto, Hachioji (JP); Takashi Nara, Niiza (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1008 days.

(21) Appl. No.: 11/882,922

(22) Filed: Aug. 7, 2007

(65) Prior Publication Data

US 2008/0253786 A1 Oct. 16, 2008

(30) Foreign Application Priority Data

Aug. 21, 2006 (JP) ..... 2006-224402

(51) Int. Cl.
*G03G 15/20* (2006.01)

(52) U.S. Cl. ..... 399/70; 399/76; 399/301

(58) Field of Classification Search ..... 399/69, 399/70, 301, 76
See application file for complete search history.

(56) References Cited

U.S. PATENT DOCUMENTS 5,030,994 A * 7/1991 Roman et al.
5,587,771 A 12/1996 Mori et al.
5,918,087 A * 6/1999 Kimura et al. ..... 399/69
6,317,147 B1 * 11/2001 Tanaka ..... 399/301
2002/0044788 A1 * 4/2002 Kawano et al.

FOREIGN PATENT DOCUMENTS

| | | |
|---|---|---|
| JP | 8-006347 | 12/1996 |
| JP | 2004-013101 | 1/2004 |
| JP | 2004-117469 | 4/2004 |
| JP | 2005-250311 | 9/2005 |

OTHER PUBLICATIONS

Notice of Reasons for Refusal issued by Japan Patent Office on Feb. 2, 2011 in corresponding Application No. JP 2006-224402 (7 pages).
English-language translation of Notice of Reasons for Refusal issued by Japan Patent Office on Feb. 2, 2011 in corresponding Application No. JP 2006-224402 (9 pages).

* cited by examiner

*Primary Examiner* — David M Gray
*Assistant Examiner* — Laura K Roth
(74) *Attorney, Agent, or Firm* — Finnegan, Henderson, Farabow, Garrett & Dunner, LLP

(57) ABSTRACT

An image forming apparatus having a process correction mode wherein when a temperature of a fixing device in an image formation system in a power-on state is equal to or less than a predetermined value, the image forming apparatus increases the fixing temperature to the predetermined value. The apparatus sets the process correction mode based on power-on information output from a first detector which detects presence of the power-on state for the fixing device and fixing temperature information output from a second detector which detects a fixing temperature in the fixing device, and sets a priority level for performing a correction processing of the color misregistration to be lower than a correction processing comprising an image density adjustment.

11 Claims, 18 Drawing Sheets

CR
12A
(i)
θ
SECONDARY SCANNING DIRECTION
(ii)

t
L1
S21
Lth
a
b
c
d
L2

VTOP

SP=Dp
t0
ta
tb
tc
td
FIG. 10 (E) D[T1]
T1
FIG. 10 (F) D[T2]
T2
FIG. 10 (G) D[T3]
T3
FIG. 10 (H) D[T4]
T4

IMAGE FORMING APPARATUS FOR IMAGE DENSITY ADJUSTMENT

This application is based on Japanese Patent Application No. 2006-224402 filed on Aug. 21, 2006, which is incorporated hereinto by reference.

BACKGROUND OF THE INVENTION

This invention relates to an image forming apparatus which is suitably applied to a tandem type color printer, color copier or a color multifunctional peripheral thereof, having a photoreceptor drum and an intermediate transfer belt, as well as a process correction mode and a correction mode of color misregistration (processing).

In recent years, the tandem type color printer and the color copier as well as the color multifunctional peripheral thereof have been widely used. In this type of color image forming apparatus, in order to suitably maintain color image print quality (color reproductive quality), yellow (Y), magenta (M), cyan (C), and black (BK) which reproduce the red (R), G (green) and B (blue) in the document image are superimposed on the intermediate transfer belt. The color image formed on an intermediate transfer belt is transferred to a predetermined sheet then fixed at a predetermined temperature.

In order to superimpose the colors Y, M, C and BK with good reproductive qualities, positive color misregistration correction in the image forming unit is essential (called correction processing of color misregistration hereinafter).

For correction processing of color misregistration, the color misregistration detection mark (called registration mark hereinafter) for position detection that is formed on the intermediate transfer belt or the conveyance material transfer belt is detected by a color misregistration sensor (called registration sensor hereinafter) such as a reflection type sensor or the like, and the color misregistration amount for the registration marks of the other colors are calculated with respect to the registration mark of the reference color. Feedback is sent to the colors Y, M and C image forming units such that the color misregistration amount is eliminated and the writing timing for the laser light source is corrected to thereby obtain a good quality color image.

On the other hand, in this type of color copier, in power-saving state where the power source plug is plugged into the power outlet, power is supplied to control systems required for minimum operation such as the clock function and the fax delayed receiving function and the like, and a system is adopted in which, for example, power supply to the fixing device in the image forming system which is required for normal operation is stopped and energy is thereby conserved.

At least when the temperature of fixing device in the image forming system is less than a predetermined value, the operation by which the fixing temperature is increased to a predetermined value is the process correction mode, and the process correction mode is set for example at the first power-on when the power supply for the copier is first turned on. A specific example is the case of use in an office, school or the like, when a person who arrives to work in the morning of a particular day and switches on the power source for the color copier for the first time in the morning. In other words, a specific example is the case of the first power-on on that day.

In the color copier, in the case where the process correction mode is set, warming up and process correction processing such as correction processing of color misregistration, image density adjustment and the like are performed. In the correction process of color misregistration, first, the process of writing the registration mark in the image area of the photoreceptor drum is performed. That is to say, correction process of color misregistration is performed before the printing operations related to the image formation job are performed. In the foregoing correction process of color misregistration, after the process of writing the registration mark is performed, the time for the passage of the registration mark is read and the amount of mispositioning of the registration marks of the other colors with respect to the reference registration mark is calculated, and the image formation position is corrected based on the amount of mispositioning. As a result, during regular operation, the colors Y, M, C and BK can be superimposed with good reproductive quality. An image formation job request can be received during these correction operations and at the point when all the correction operations are complete, the image forming operations begins.

In this type of color copier, the power saving mode is often set before the process correction mode is set. In this state, the power supply plug of the copier is connected to a commercial power source, and the power supply to the image forming unit is cut off and power required for minimum operation is supplied to other load circuits such as the clock function, the CPU function, the monitor display function, the communication function (facsimile) and the like. It is to be noted that when a facsimile is being received, if the power saving mode is cancelled, and the device transitions to the normal operation mode. In the normal operation mode, power is also supplied to the fixing device of the image forming system in addition to load circuits other than the control system and the image formation job is performed and then the image formation job is queued.

A color image forming apparatus relating to the foregoing color copier is described in Unexamined Japanese Patent Application Publication No. 2005-91901 (Page 7, FIG. 9). According to this color image forming apparatus, a position detection pattern is detected, and in the case where correction process of color misregistration is performed based on the results of the detection, a non-image part density pattern is formed and the density pattern is detected, and the conditions for creating the position detection pattern at the time of correction process of color misregistration are determined. When the color image forming apparatus is constructed in this manner, the correction process of color misregistration can be performed with a position detection pattern in which the density is adjusted.

It is to be noted that the color image forming apparatus of the prior art has the following problems.

(i). In the process correction mode in which the power switch is turned on for the first time in the morning, an image formation job can be received during the correction process of color misregistration, but the image forming process actually begins at the point when the correction processes are complete. Thus, the users strongly feel that they must wait a long time until image formation actually begins after the power switch is turned on.

(ii). The time required for the correction process of color misregistration is about 1-2 minutes. In the recent fixing devices that use the IH (Induction Heating) heater and the like, the warm-up times has been shortened to under 30 seconds and the fixing temperature is reached in a shorter period compared to conventional types. Despite this, in the copier which carries out the process correction mode and the correction process of color misregistration, there is a problem in that it cannot proceed to a state where copying is permitted (possible) because warming up and correction process of color misregistration is not completed.

(iii). Given the foregoing correction process of color misregistration at first power-on, a method may be considered which employs a structure in which the registration mark (also called mark image hereinafter) is created at a position with sufficient margin for paper offsetting at both sides of the image area and the correction process of color misregistration is done in real time (Density patch image in Unexamined Japanese Patent Application Publication No. 2005-91901).

In this method as well, in the case where the priority ranking for the correction process of color misregistration is ranked high among process correction processing done at first power-on, until all the process correction processing apart from correction process of color misregistration done for the at first power-on complete, as is the case in (ii) above, even if a monochrome image formation job is received, there is a problem in that transition is not possible to a state where copying in the image forming process is permitted (possible).

SUMMARY OF THE INVENTION

According to one embodiment of the present invention, an image forming apparatus performs at least correction processing of color misregistration in the image formation system and correction processing of process other than correction processing of color misregistration, wherein when the temperature of fixing device in the image formation system is equal to or less than a predetermined value in the power-on state, the fixing temperature is increased to the predetermined value, and the start-up operation of the fixing device in the state where correction processing of process is possible is called the process correction mode. The image forming apparatus is provided with a first detector which detects presence of the power-on state for the apparatus; a second detector which detects a fixing temperature in the fixing device; and a controller in which the process correction mode is set based on the power-on information output from the first detector and the temperature fixing information output from the second detector and the priority level for performing the correction processing of color misregistration is set to be lower than correction processing of process other than the correction processing of color misregistration.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 10(A)-10(H) shows an example of binarization of the image detection signal S21 using the registration sensor 12A and like.

DETAILED DESCRIPTION OF THE PREFERRED EMBODIMENT

The image forming apparatus of the embodiments of this invention will be described with reference to the drawings in the following.

Figure 1:
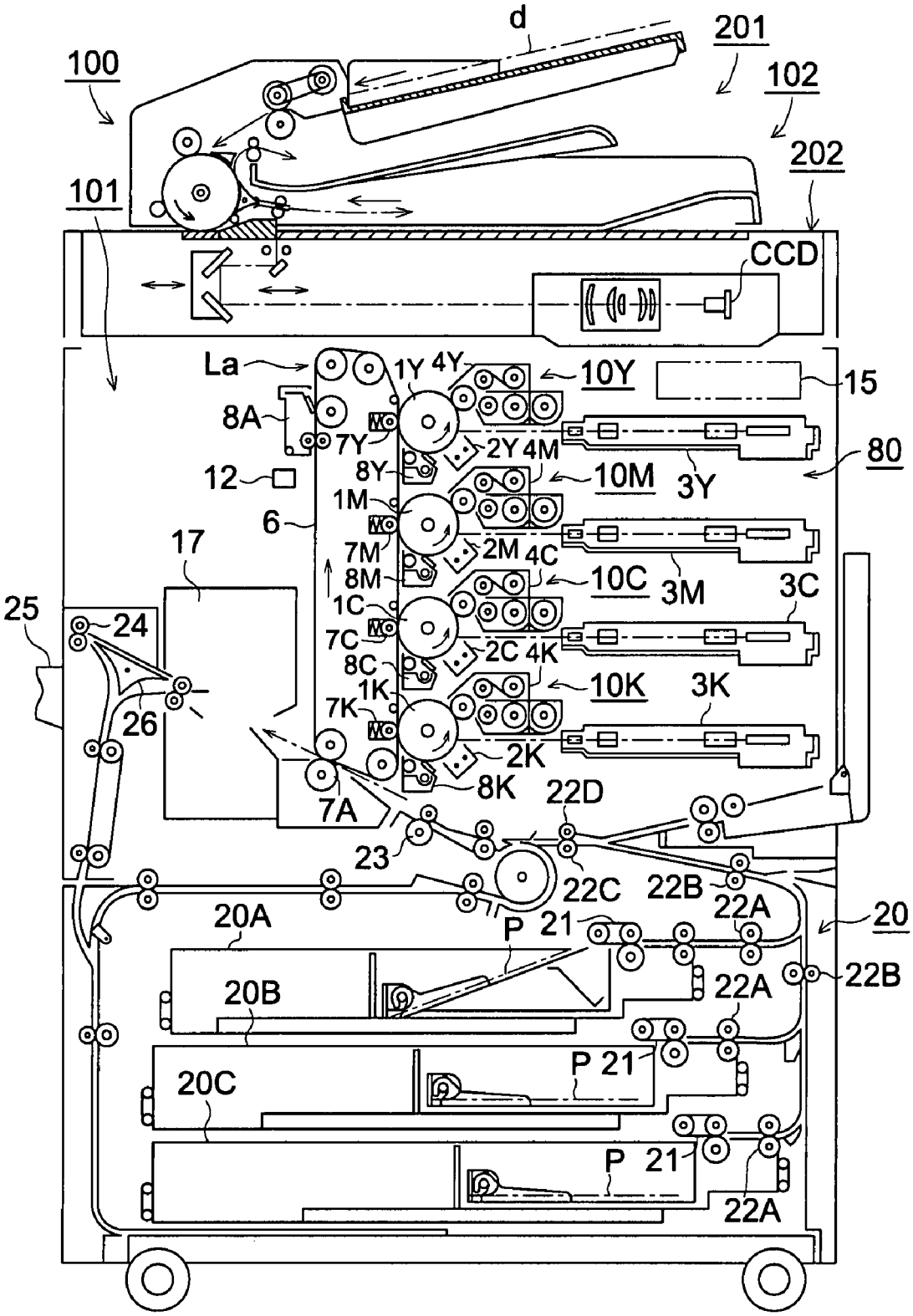
FIG. 1 is a schematic drawing showing an example of the structure of the color copier 100 as an embodiment of this invention.

FIG. 1 is a schematic drawing showing an example of the structure of the color copier 100 as an embodiment of this invention.

The color copier 100 shown in FIG. 1 is one example of the tandem type color image forming apparatus, and color images are formed by superimposing color on an image carrier based on image information. In this example, in the power-on state and when the temperature of the fixing device in the image forming system is less than a predetermined value, the fixing temperature is increased to a predetermined value in the color copier 100, and the operation for starting up the apparatus in a state in which correction processing of process is possible is called the process correction mode, and after the process correction mode is set, the transition is made to the regular operation mode. In the regular operation mode, power is supplied to the image forming system in addition to load circuits other than the control circuit, and the apparatus is brought into a state where an image formation job can be performed or to the standby mode where an image formation job is on standby. The standby mode refers to the operation of minimizing the power consumption in the image forming system and putting the image formation jobs on standby.

In this example, the process correction mode may, for example, be the case where the power source for the color copier 100 is turned on for the first time. In addition, this also applies to the case where the time or period during which the color copier is not being used is long, and after the period elapses the power source for the copier 100 is turned on. An example of this is the case where the elapse time from the previous power-off to the corresponding power-on exceeds a predetermined value, or the case where the elapse time from when the transition is made to the standby mode to power-on exceeds a predetermined value. During this period, the fixing temperature is substantially ordinary temperature since power is not being supplied to the fixing device 17 or power consumption is minimized.

When the color copier 100 is set in the process correction mode, correction processing of color misregistration is performed based on priority ranking. The copier 100 performs the real time correction mode (color registration correction processing). Real time correction mode herein refers to the operation of performing in parallel, the process of writing the image on the image area of the image carrier and the process of writing the registration mark image in the non-image area thereof. In other words, it refers to the operation of performing correction processing of color misregistration in parallel and substantially simultaneous with the printing operations relating to the image formation job.

In the foregoing real time correction mode, after the mark image writing process is performed, the timing for the passage of the mark image is read and the amount of mispositioning of the mark images of the other colors with respect to the reference color is calculated, and the image formation position is corrected based on the amount of mispositioning (correction processing of color misregistration). In this example, at first power-on of the color copier 100 and when the process correction mode is set, correction processing of color misregistration that is performed based on priority ranking in particular is called the first power-on correction mode. Hereinafter the process correction mode set at first power-on and first power-on correction mode are defined to be the same.

The color copier 100 is constituted of a copier main body 101 and an image reading apparatus 102. An image reading device 102 comprising an automatic document feeder 201 and a document image scanning and exposure device 202 is installed above the copier main body 101. The document "d" that is placed on the document tray of the automatic document feeding device 201 is conveyed by a conveyor that is not shown, and the images on one or both surfaces of the document are scanned and exposed image wise using the optical system of the document image scanning and exposure device 202, and the incident light reflected by the document image is read by a line image sensor CCD.

The analog image signals photoelectrically converted by the line image sensor CCD were subjected to analog processing, A/D conversion, shading correction and image compression processing and the like in the image processing section that is not shown and converted to digital image information. The image information is sent to the image forming section 80. The image forming section 80 has image carriers for each of the colors Y, M, C and K and is provided with multiple sets of image forming units (also called image forming systems II) 10Y, 10M, 10C, and 10K; an endless intermediate transfer belt 6 (also called image transfer system I hereinafter); and a sheet feed section including a sheet re-feeding (Automatic Duplex Unit mechanism); and a fixing device 17 for fixing toner images.

In this example, the image forming unit 10Y has the photoreceptor drum 1Y, the charger 2Y, the writing unit 3Y, the developing unit 4Y and the cleaning unit 8Y for the image carrier, and it forms yellow (Y) images. The photoreceptor drum 1Y is one example of an image carrier and it may, for example, be provided close to the upper right portion of the intermediate transfer belt 6 so as to be rotatable and it forms color Y toner images. In this example, the photoreceptor drum 1Y is rotated counterclockwise by a drive mechanism which is not shown. The charger 2Y is provided diagonally at the lower right side of the photoreceptor drum 1Y and the surface of the photoreceptor drum 1Y is charged with a predetermined electric potential.

The writing unit 3Y which has each of the laser light sources is substantially directly across from the photoreceptor drum 1Y, and the receptor drum 1Y which was charged in advance was scanned using a color Y laser beam having a predetermined intensity based on the image data for color Y. This laser beam may, for example, be rotated by a polygon mirror for color Y and then subjected to deflection scanning, or writing in the so-called primary scanning direction for the color Y image data. The primary scanning direction is the direction that is parallel to the rotation axis of the photoreceptor drum 1Y. The photoreceptor drum 1Y rotates in the secondary scanning direction. The secondary scanning direction is the direction orthogonal to the rotation axis of the photoreceptor drum 1Y. Electrostatic latent images for color Y are formed on the photoreceptor drum 1Y by rotation of the photoreceptor drum 1Y in the secondary scanning direction and deflection scanning in the primary scanning direction of the laser beam.

There is provided a developing unit 4Y above the writing unit 3Y and this is operated to develop the latent color Y images that are formed on the photoreceptor drum 1Y. The developing unit 4Y has a developing roller for color Y that is not shown. Toner for color Y and a carrier are stored in the developing unit 4Y. Magnets are arranged inside the developing roller for color Y. A two-component developer which is obtained by mixing the carrier and the color Y toner inside the developing unit 4Y is conveyed by rotation at a location opposing the photoreceptor drum 1Y and the latent image from the color Y toner is developed. The color Y toner image that is formed on the photoreceptor drum 1Y is transferred to the intermediate transfer belt 6 by operating the primary transfer roller 7Y (primary transfer). There is provided a cleaning unit 8Y at the lower left side of the photoreceptor drum 1Y and this removes (cleans) toner remaining on the photoreceptor drum 1Y from the previous writing.

In this example, the image forming unit 10M is provided under the image forming unit 10Y. The image forming unit 10M has the photoreceptor drum 1M, the charger 2M, the writing unit 3M, the developing unit 4M and the image forming body cleaning unit 8M, and it forms magenta (M) images. The image forming unit 10C is provided below the image forming unit 10M. The image forming unit 10C has the photoreceptor drum 1C, the charger 2C, the writing unit 3C, the developing unit 4C and the image forming body cleaning unit 8C, and it forms cyan (C) images.

The image forming unit 10K is provided below the image forming unit 10C. The image forming unit 10K has the photoreceptor drum 1K, the charger 2K, the writing unit 3K, the developing unit 4K and the image forming body cleaning unit 8K, and it forms black (BK) images. Organic photoconductor (OPC) drums are used for the photoreceptor drums 1Y, 1M, 1C and 1K.

It is to be noted that the functions of each of the members of the image forming units 10M-10K is obtained by replacing Y with M, C and K for image forming unit 10Y with the same number and thus descriptions thereof have been omitted. Primary transfer bias voltage with the opposite charge from the toner that is used (positive charge in this embodiment) is applied to the foregoing primary transfer rollers 7Y, 7M, 7C and 7K.

The intermediate transfer belt 6 is one example of an image carrier and it forms a color toner image (color image) by superimposing the toner images transferred by the primary transfer rollers 7Y, 7M, 7C and 7K. For example, the color image formed on the intermediate transfer belt 6 is conveyed toward the secondary transfer roller 7A by rotating clockwise the intermediate transfer belt 6. The secondary transfer roller 7A is positioned below the intermediate transfer belt 6 and the color toner images formed on the intermediate transfer belt 6 are transferred together to the sheet P conveyed from the sheet feeding section 20.

The sheet feeding section 20 may, for example, be provided below the aforementioned writing unit 3K and has sheet trays 20A, 20B and 20C. The sheets P that are stored inside the sheet trays 20A, 20B and 20C are fed by the sheet feed roller 21 and the sheet roller 22A in the sheet trays 20A, 20B and 20C are conveyed to the secondary transfer roller 7A via the conveyance roller 22B, 22C and 22D and the registration rollers 23 and 28 and the like.

A fixing device 17 is provided at the left side of the secondary transfer roller 7A, and it performs the fixing processing for the sheet P onto which the color images were transferred. The operating temperature for the fixing device 17 is about a few hundred degrees Celsius. The fixing device 17 has a fixing roller, a pressurizing roller, and a heater (Induction Heating). In the fixing processing, the sheet P passes between the fixing roller and the heating roller that are heated by the heater and the sheet P is thereby heated and pressure is applied. The sheet P that has been fixed interposed between the ejection rollers 24 and loaded on the external sheet ejection tray 25.

In this example, the cleaning unit 8A is provided above the left side of the intermediate transfer belt 6 and it cleans the toner that remains on the intermediate transfer belt 6. The cleaning unit 8A has a charge removal section for removing the charge on the load of the intermediate transfer belt 6 and a pad for removing the toner remaining on the intermediate transfer belt 6. The belt surface is cleaned by the cleaning unit 8A and the intermediate transfer belt 6 whose charge has been removed by the charge removal section enters the next image formation cycle. As a result color image formation is done on the sheet P.

Registration sensors 12A and 12B (not shown) are provided at the upstream side of the cleaning unit 8A of the copier main body 101 which is the area where the ends of the upper surface of the intermediate transfer belt 6 can be seen through, and the registration marks CR for each of the colors Y, C, M and BK for color misregistration correction that are formed on both ends of the intermediate transfer belt 6 by the aforementioned image forming units 10Y, 1M, 10C and 10K are detected and an image detection signal is generated. The real time correction mode can be executed based on the image detection signal.

Figure 2:
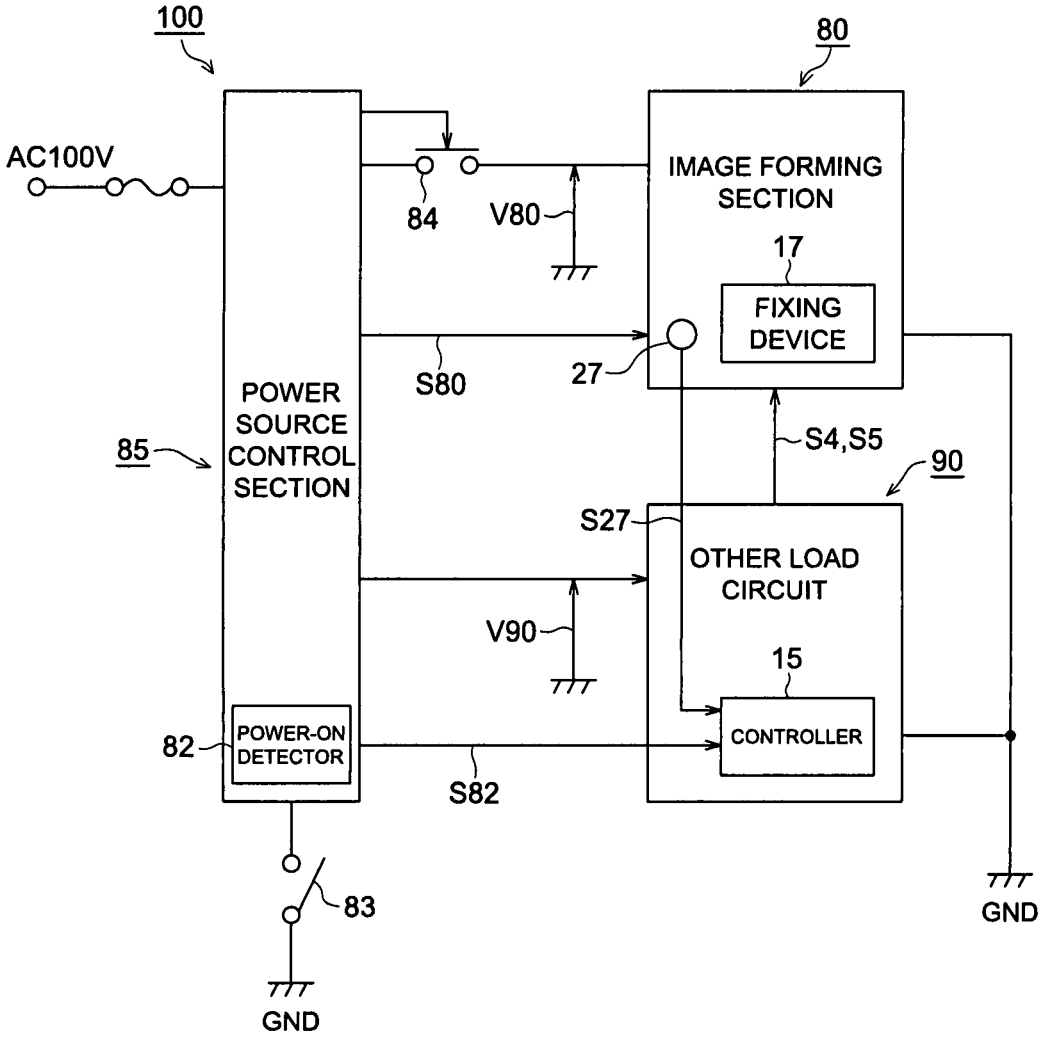
FIG. 2 is a block diagram showing an example of the power supply for the color copier 100.

An example of power supply to the image forming section 80 which carries out this type of real time correction mode is described in the following. FIG. 2 is a block diagram showing an example of the power supply for the color copier 100. The color copier shown in FIG. 2 has at least a power source for the image forming section 80 and a power source control section 85 for controlling power sources other than that for the image forming section 80.

The image forming section 80 and the other load circuit 90 are connected to power source control section 85. The power source control section 85, the image forming section 80 and the other load circuit 90 are grounded (GND). The image forming section 80 includes the image forming unit 10Y, 10M, 10C and 10K and the fixing device 17 described in FIG. 1 and the other load circuit 90 includes the controller 15 as well as the non-volatile memory 14 described in FIG. 3, the operation section 16, the display section 18 and a communication modem and the like which are not shown. The fixing device 17 has a temperature sensor 27 which is an example of the second detector, and the fixing temperature is detected in the fixing device 17 and the fixing temperature detection signal S27 is output to the controller 15.

The power source control section 85 is connected to a commercial power source (such as 100V AC). A power source switch 83 for user use is connected to the power source control section 85 and it is operated so as to turn the power source on and off.

In this example, the power-on detector 82 as the first detector is provided in the power source control section 85, and it detects the ON operation of the power source switch 83 and thus detects whether the power source for the image forming section 80 is on or off. The controller 15 is connected to the power-on detector 82, and when the power source switch 83 is turned on, the power-on signal S82 (power-on information) that is output from the power-on detector 82 sets the elapse time information from the previous power-off to the current power-on (called first elapse time information hereinafter); the elapse time information from the time when the transition is made to the standby mode to the time when the power is turned on (called second elapse time hereinafter); and the process correction mode (first power-on correction mode) based on the fixing temperature detection signal S27 that is obtained from the temperature sensor 27 and the priority level for carrying out the correction processing of color misregistration is set to be lower than that of correction processing of process other than correction processing of color misregistration.

The first and second elapse time information may be monitored by using a timer provided inside the controller 15 for example. The first elapse time information is obtained by measuring the time elapsed from when the timer is started at the previous power-off to the corresponding power-on. The second elapse time information is obtained by measuring the time elapsed from when the timer is started at the transition to the standby mode to when the corresponding power-on is reached.

A relay switch 84 for power supply controls connects the power source control section 85 and the image forming section 80, and it is controlled to be on or off based on the process correction mode. For example, if the power source switch 83 is turned on, and the process correction mode is set by the controller 15, the relay switch 84 is turned on and the power source control section 85 supplies power (for example voltage 80V) to the image forming section 80. When the power is supplied, the image forming section 80 carries out the process correction mode and subsequently transitions to the regular operation mode.

The power source switch 83 is turned off, the process correction mode is cancelled and a transition is made to the power saving mode. In the power saving mode, power supply to the image forming section 80 may be cut and power required for minimum operation is supplied other load circuit 90 such as the time function, the CPU function, the monitor display function and the communication function (fax) and the like. For example, the power source control section 85 may supply a direct current voltage 90V to the load circuit 90. It is to be noted that when a fax is received, the power saving mode is cancelled and a transition is made to the normal operation mode.

In this example, if an image formation job is not requested within a set time during the period that the normal operation mode is set, the standby mode will be set. In the standby mode for example, the power saving control signal S80 is output to the image forming section 80 from the power source control section 85. In the image forming section 80, the fixing temperature of the fixing unit 17 may be reduced based on the power saving control signal S80 and power consumption is thereby controlled so as to be reduced.

In the process correction mode or in the regular operation mode, the controller 15 outputs an image processing control signal S4 and a writing control signal S5 to the image forming section 80 and image formation control is thereby carried out.

Figure 3:
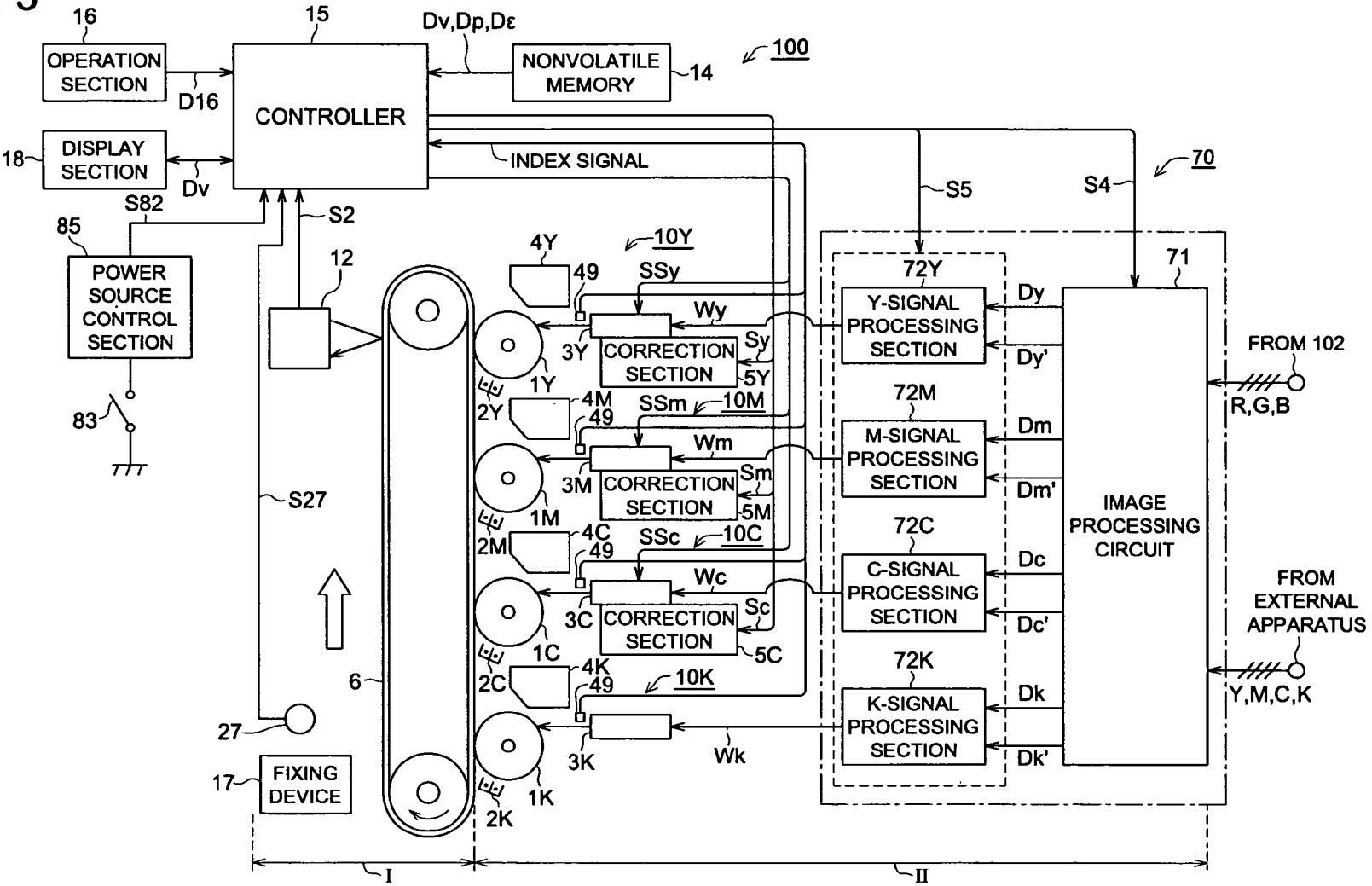
FIG. 3 is a block diagram showing examples of the structure of the image transfer system I and the image forming system II of the color copier 100.

Next, an example of the structure of the control system for the color copier 100 will be described. FIG. 3 is a block diagram showing examples of the structure of the image transfer system I and the image forming system II of the color copier 100. In the color copier 100 shown in FIG. 3, the processing system including the intermediate transfer belt 6 and the registration sensor 12 and the like shown in FIG. 1 is the image transfer system I, while the image forming units 10Y, 10M, 10C and 10K are isolated as the image forming system II.

In FIG. 3, the color copier 100 has the image forming units 10Y, 10M, 10C and 10K, registration sensor 12, the non-volatile memory 14, the controller 15, the operation section 16, the display section 18 and the image processing section 70.

The power source control section 85 and the temperature sensor 27 are connected to the controller 15, and when the power source switch 83 is on, the power-on detection signal S82 is input and the fixing temperature signal S27 is also input to the controller 15. The controller 15 sets the process correction mode based on the power-on detection signal S82 (power-on information) output from the power-on detector 82 shown in FIG. 2 and the fixing temperature signal S27 output from the temperature sensor 27 and the priority level for executing the correction processing of color misregistration is set to be the lowest. Due to this setting, warm-up operation and image correction during correction processing when in the process correction mode is carried out first and correction processing of color misregistration (real time correction mode) is carried out last and thus it becomes possible to perform the image formation job before correction processing of color misregistration is carried out.

After the controller 15 performs correction processing other than correction processing of color misregistration in the image forming section 80 based on the process correction mode, the image formation job is accepted. The controller 15 carries out the real time correction mode in parallel with the image formation job that was accepted after the process correction mode was carried out.

A registration sensor 12 is connected to the controller 15 and in the real time correction mode, the registration mark CR that is formed on one end edge (or both ends edges) on the intermediate transfer belt 6 is detected and the image detection signal S2 is output. The image detection signal S2 includes a front end edge detection signal component and a rear end edge signal component.

A reflection type optical sensor or an image sensor is used as the registration sensor 12. The sensor is equipped with a light emitting element and a light receiving element, and light is radiated from the light emitting element onto the registration mark CR and the reflected light is detected at the light receiving element. The controller 15 controls the exposure timing of the writing units 3Y, 3M, 3C based on image detection data Dp in which analog-to-digital conversion was done using the image detection signal S2 obtained from the registration sensor.

The operation section 16 is connected to the controller 15 and in the process correction mode or the normal print mode, operation data D16 is input when the instructions for image formation conditions by the user such as selecting the sheet P or setting for the sheet feeding tray and the like. These operations are performed by the user. The display section 18 which comprises a display unit in addition to the operation section 16 is connected to the controller 15. A liquid crystal display is used for the display section 18 and the liquid crystal display is used in combination with a touch panel which forms the operation section 16 and is not shown.

In addition to the operation section 16, the image control processing section 70 is connected to the controller 15. The image processing section 70 has an image processing circuit 71, a Y-signal processing section 72Y, a M-signal processing section 72M, a C-signal processing section 72C, and a K-signal processing section 72K. The R, G and B signals for R, G and B color components of the color image that is read from the document and the Y, M, C and K signals from a suitably selected printout that is output from an external device such as a printer are input into the image processing circuit 71.

In the image processing circuit 71, R, G and B signals are subjected to color conversion based on the image processing control signal S4 and the image data Dy is output to the Y signal processing section 72Y. In addition, in the real time correction mode, the image data Dy' for color misregistration correction based on the image processing control signal S4 is output to the Y signal processing section 72Y. Here, the image data Dy is data that has been subjected to analog-to-digital conversion using the color Y image forming signals for the job in the normal image forming mode. The image data Dy' is data for forming the color Y (yellow) registration mark.

Similarly, the image processing circuit 71 outputs image data Dm to the M-signal processing section 72M. In the real time correction mode, the image data Dm' for color misregistration correction is output to the M-signal processing section 72M. Here, the image data Dm is color M (magenta) image forming data for the image formation job. The image data Dm' is data for forming the color M (magenta) registration mark.

Also, the image processing circuit 71 outputs image data Dc to the C-signal processing section 72C. In the real time correction mode, the image data Dc' for color misregistration correction is output to the C-signal processing section 72C. Here, the image data Dc is color C (cyan) image forming data for the image formation job. The image data Dc' is data for forming the color C (cyan) registration mark.

Also, the image processing circuit 71 outputs black color image data Dk to the K-signal processing section 72K. In the real time correction mode, the image data Dk' for color misregistration correction is output to the K-signal processing section 72K. Here, the image data Dk is color BK (black) image forming data for the normal image formation job. The image data Dk' is data for forming the color BK (black) registration mark. The image processing control signal S4 is output to the image processing circuit 71 from the controller 15.

The Y-signal processing section 72Y combines the image data Dy and the image data Dy' based on the writing control signal S5 and outputs the image data Dy and the image data Dy' to the writing unit 3Y. The writing unit 3Y detects the radiation timing for the color Y (yellow) laser light and outputs the laser detection signal (called Y-INDEX signal hereinafter). The other signal processing sections which are the M-signal processing section 72M, the C-signal processing section 72C and the K-signal processing section 72K operate in the same manner as the Y-signal processing section 72Y and so descriptions thereof have been omitted.

In addition to the image processing section 70, the image forming units 10Y, 1M, 10C and 10K are connected to the controller 15, and in the image forming unit 10Y, color Y (yellow) toner images are formed on the intermediate transfer belt 6 via the photoreceptor drum 1Y, based on the color Y (yellow) writing data Wy output from the image processing section 70. The writing data Wy includes the image data Dy in the regular image forming mode and the image data Dy' for forming the registration mark in the real time correction mode or correction processing of color misregistration.

In this example, when the real time correction mode is carried out, the writing data Wy which is equal to the image writing data Dy plus the image writing data Dy' is output to the writing unit 3Y. That is to say, the normal image data Dy for image formation that is to be written on the image area of width W1 and the image data Dy' for color misregistration correction that is to be written on the width W2 of the both ends and the non-image area of W2*r* are serially combined by the Y-signal processing section 72Y and then output to the writing unit 3Y. The normal correction processing of color misregistration is different in that the writing data Wy which is equal to image data Dy' is output to the writing unit 3Y. The operation for the other writing units 3M, 3C and 3K are the same and thus descriptions thereof have been omitted.

In the writing units 3Y, 3M, 3C and 3K, control is done such that the registration mark CR for color misregistration correction is formed by the controller 15 on the intermediate transfer belt 6 via the photoreceptor drums 1Y, 1M, 1C and 1K. In this example, when the controller 15 is to detect the registration mark CR formed on the intermediate transfer belt 6, it detects the registration mark CR on the intermediate transfer belt 6 with the writing start signal as a reference (called VTOP hereinafter) which allows writing of the registration marks on the photoreceptor drum 1Y, 1M, 1C and 1K to start, and the color misregistration correction data De is calculated.

In this example, the color Y (yellow) writing unit 3Y is attached to the correction section 5Y and the incline of the horizontal position of the writing unit 3Y is adjusted based on the unit position correction signal Sy from the correction section 15. Similarly, the color M (magenta) writing unit 3M is mounted to the correction section 5M and the incline of the horizontal position is adjusted based on the unit position correction signal Sm from the correction section 15. The color C (cyan) writing unit 3C is mounted to the correction section 5C and the incline of the horizontal position of the writing unit 3C is adjusted based on the unit position correction signal Sc from the correction section 15 (Referred as correction processing of partial lateral magnification).

In this example, the registration mark CR for color BK (black) is used as a reference for calculating the color misregistration amount. The writing position for color image of colors Y, M and C are adjusted to match color BK (black). For example, the writing position of the registration mark CR for color BK (black) and the writing position of the registration mark CR for color Y (yellow) are detected and the correction amount is calculated from the misregistration amount for the writing position of the registration mark CR for color Y (yellow) and the writing position of the registration mark CR for color BK (black). Similarly, in writing position adjustment for colors M and C, misregistration amounts between the writing position of the registration mark CR for color M (magenta) or color C (cyan) and the writing position of the registration mark CR for color BK (black) are each detected and the correction amount is calculated from each misregistration amount. Subsequently, the image formation positions for colors Y, M and C are adjusted.

In addition to the image forming section 70, a non-volatile memory 14 is connected to the foregoing controller 15. The image detection data Dp, the color misregistration correction data Dε, and the display data Dv and the like are stored in the non-volatile memory 14. A hard disk or EEPROM is used as the non-volatile memory 14. The adjustment value of the first power-on correction mode obtained by the real time correction mode in parallel with the image formation job is stored in the non-volatile memory 14.

In addition to the foregoing adjustment value, the adjustment value used in the color misregistration process when a previous process correction mode is carried out or a default adjustment value which is obtained in the manufacturing adjustment step is stored in the non-volatile memory 14. When the adjustment value is stored in the non-volatile memory 14 in this manner, the adjustment value read from the non-volatile memory 14 can be used for correction processing of color misregistration in the normal operation mode and in the correction processing of color misregistration when the print mode is carried out the following morning.

In this example, correction processing of color misregistration is performed by the real time correction mode in parallel and substantially simultaneous with the print operations for the image formation job. In the real time correction mode, an image formation job can start based on the correction value from the previous day that was stored in the non-volatile memory 14 or based on the default correction value and as a result the wait time for the user is shortened.

Figure 4:
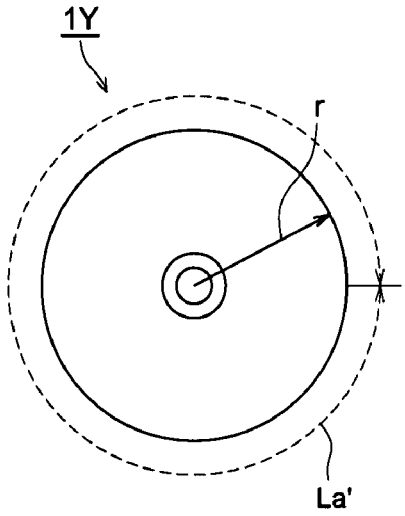
FIGS. 4(A) and 4(B) are side and front views showing an example of the structure of the photoreceptor drum 1Y.
Figure 4:
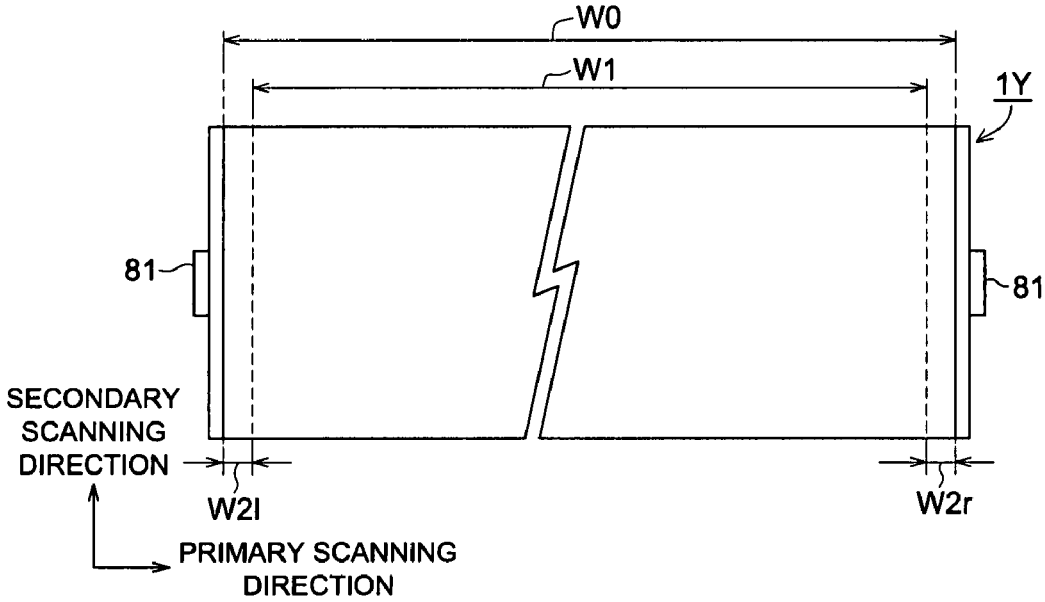

FIGS. 4(A) and 4(B) are side and front views showing an example of the structure of the photoreceptor drum 1Y. In this example, in the photoreceptor drums 1Y, 1M, 1C and 1K of the image forming section 80, the image area of width W1 where the images to be transferred to the sheet are formed and the non-image areas of width W21 and W2*r* which are the areas other than the image area where the registration mark CR (mark image) for color misregistration is formed are aligned in the primary scanning direction, and the exposable width W0 in the primary scanning direction is set to be larger than the maximum width.

The photoreceptor drum 1Y shown in FIG. 4(A) includes an image forming unit 10Y and has a radius "r" and a peripheral length La' of $2\pi r$. The other photoreceptor drums 1M-1K have the same structure. Organic photoconductors (OPC) drums are used as the photoreceptor drums 1Y, 1M, 1C and 1K.

The photoreceptor drum 1Y shown in FIG. 4(B) has an exposable width W0. The exposable width W0 forms the primary scanning direction width of the maximum image forming area. The exposable width W0 is substantially the same as the laser scanning width for the writing unit 3Y, and for example the maximum image forming area may be divided into the image forming area of width W1 (effective image forming area) and the non-image areas of width W21 and W2*r*. The non-image areas are assigned to both sides of the effective image area.

The photoreceptor drum 1Y has a rotation axis 81. The photoreceptor drum 1Y rotates in the secondary scanning direction. The secondary scanning direction is the direction orthogonal to the rotation axis of the photoreceptor drum 1Y. Electrostatic latent images for color Y (yellow) are formed on the photoreceptor drum 1Y by rotation of the photoreceptor drum 1Y in the secondary scanning direction and deflection scanning in the primary scanning direction of the laser beam. The other photoreceptor drums 1M-1*k* are formed in the same manner.

Next, an example of detection of the registration mark CR in the first power-on correction mode will be described.

Figure 5:
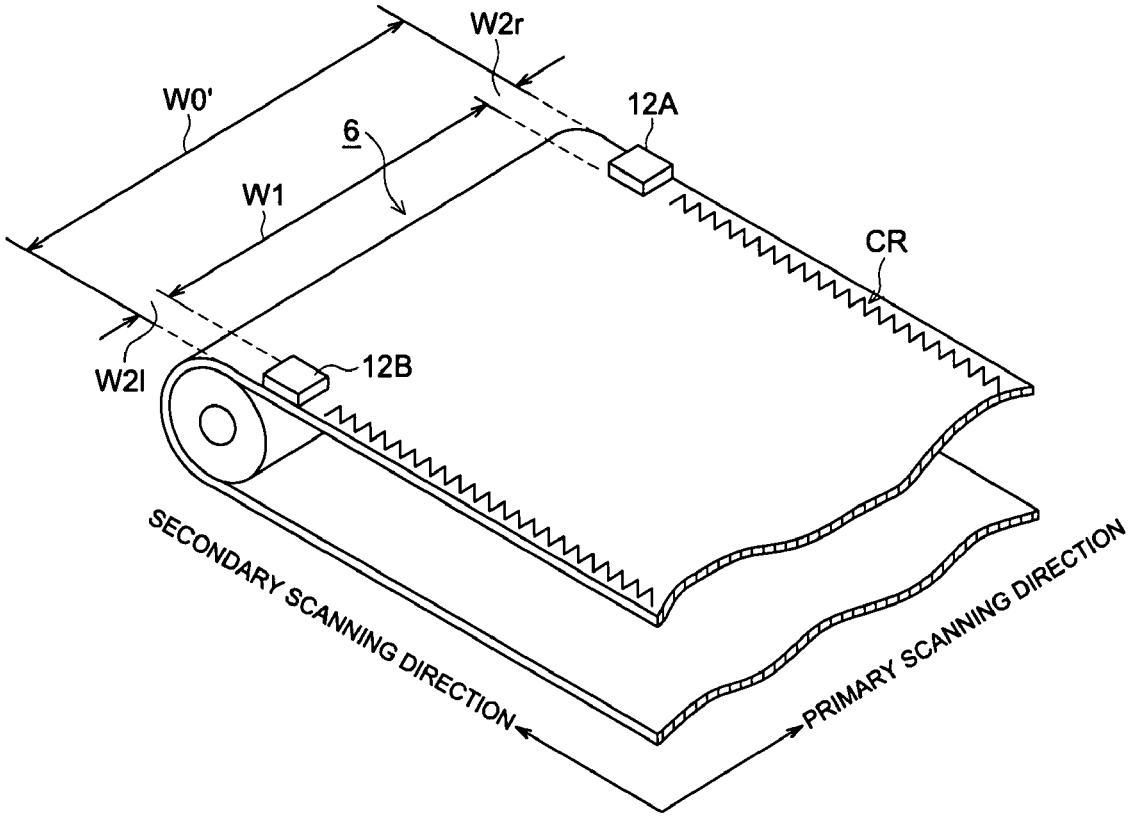
FIG. 5 is a perspective view showing an example of detection of the registration mark CR using the two registration sensors 12A and 12B.

FIG. 5 is a perspective view showing an example of detection of the registration mark CR using the two registration sensors 12A and 12B. The registration sensors 12A and 12B are provided on both ends of the intermediate transfer belt 6 area through which the surface of the intermediate transfer belt can be seen. The registration sensors 12A and 12B detect the registration marks CR formed on both sides of the intermediate transfer belt 6 using the image forming units 10Y, 10M, 10C and 10K. Optical sensors or line image sensors are used for the registration sensor 12A and 12B. The registration sensors 12A and 12B are placed on the non-image area having width of W21 and W2*r*.

The intermediate transfer belt 6 shown in FIG. 5 has a belt width W0' which is substantially the same as the exposable width W0 of the photoreceptor drums 1Y-1K in order to transfer the toner images formed by the photoreceptor drums 1Y-1K.

For example, the intermediate transfer belt 6 has a belt width W0' which is longer than the short side of the A3 size sheet P. As is the case with the photoreceptor drum 1Y and the like, the image area of width W1 and the non-image areas of width W21 and W2*r* which are the areas other than the image area where the registration mark CR of colors Y, C, M and BK for color misregistration correction is formed are aligned in the primary scanning direction and the exposable width W0 in the primary scanning direction is set to be larger than the maximum width. In the image area of width W1, images for transfer to the paper P are formed continuously with the formation of color Y, C, M and BK registration marks CR of the non-image areas of widths W21 and Wr (Referred as simultaneous writing system).

Figure 6:
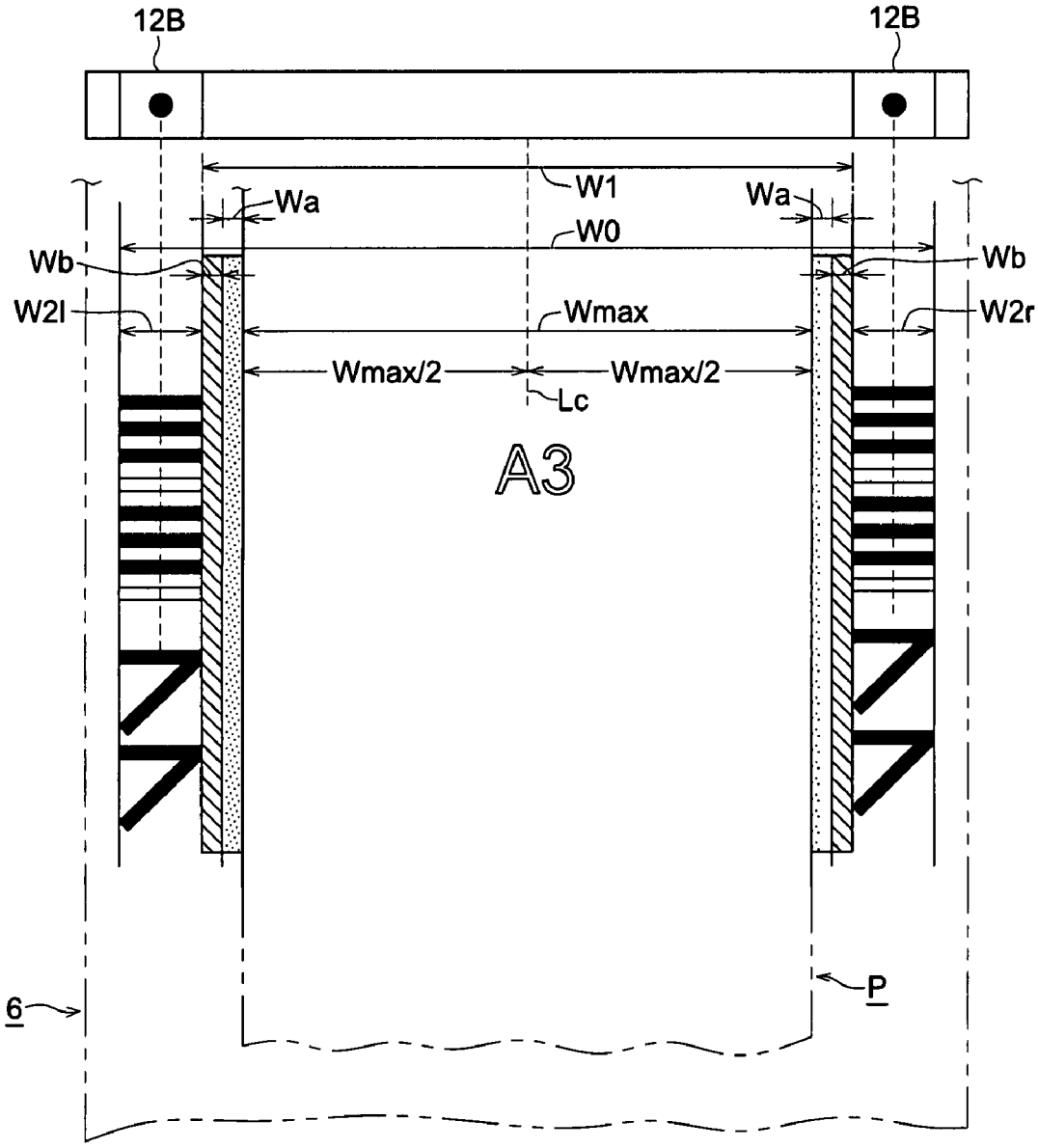
FIG. 6 is a plan view showing an example of feeding of sheet P on the intermediate transfer belt 6.

FIG. 6 is a plan view showing an example of feeding of sheet P on the intermediate transfer belt 6. In this example, a sheet P of A3 size (vertical length) is fed (set) on an intermediate transfer belt 6 having a belt width W0' which is substantially the same as the exposable width W0 of the photoreceptor drum 1Y and the like.

In the intermediate transfer belt 6 shown in FIG. 6, it is possible to transfer images to an A3 size sheet. For the intermediate transfer belt 6 to which the sheet P has been fed, given that the exposable width is W0 (=W0'); the width of the image area is W1; the widths of the non-image areas are W21 and W2*r*; the left and right writing mispositioning margin (range) is Wa; the left and right staining prevention margin is Wb; and the width of the short side of the A3 size sheet P (maximum width) is Wmax=297 mm, in the case where the image resolution is 1200 dpi, the exposable width W0 is set (designed) to be W0=324 mm by the dimension values. It is to be noted that Lc shown in FIG. 6 is the image center position and is positioned at Wmax/2. The image center position Lc is sometimes used as the reference position.

The width W2 of the image area is set at Wmax+(Wa+Wb)×2. In this example, the left and right writing mispositioning margin Wa is set at 1.5 mm and the left and right stain prevention margin Wb is set at 2 mm and the width W1 of the image area is 304 mm. The left end of the non-image area which is W21 is set at 12 mm and the right end of the non-image area which is W2*r* is also set at 12 mm. It is to be noted that in the case where primary scanning correction processing is carried out, the line width for the registration mark CR is set to 64 dot (1.35 mm).

In this example, when the ideal A3 size sheet P in which the short side width Wmax=297 mm is fed to an image forming system, a paper cutting margin Wa=2 mm and a stain prevention margin Wb=2 mm are set at both sides of the image forming area width W1 and thus real time correction mode can be carried out. In the real time correction mode, color misregistration amount is continuously detected during print operation and the write start position (write timing) for the writing unit is corrected.

In the real time correction mode, the color BK registration mark CR is used as the reference and velocity error is measured, and correction is done for the misregistration amount for the registration mark CR at each registration area. For example, registration marks CR for color misregistration correction are formed on the intermediate transfer belt 6 via the photoreceptor drums 1Y, 1M, 1C and 1K and the timing for the passage of the registration mark CR is taken and the mispositioning amount of the registration marks of the other colors are calculated with respect to the registration mark CR of the reference color and the image formation position is corrected based on the mispositioning amount. As a result, calculation in which the mispositioning amount is reflected in the velocity conversion rate obtained by the color BK (black) reference can be done.

The image forming position refers to the position where the color Y (yellow), color M (magenta), color C (cyan) and color BK (black) toner images are superimposed in the case where color images based on image data are reproduced on the intermediate transfer belt 6. The image forming position is corrected by adjusting the writing start position for the photoreceptor drum 1Y, 1M, 1C and 1K. The timing for performing the correction is performed for one page unit. In this manner, the registration mark CR for each of the colors Y, M, C and BK for color misregistration correction is no longer transferred to both ends of the sheet P.

Figure 7:
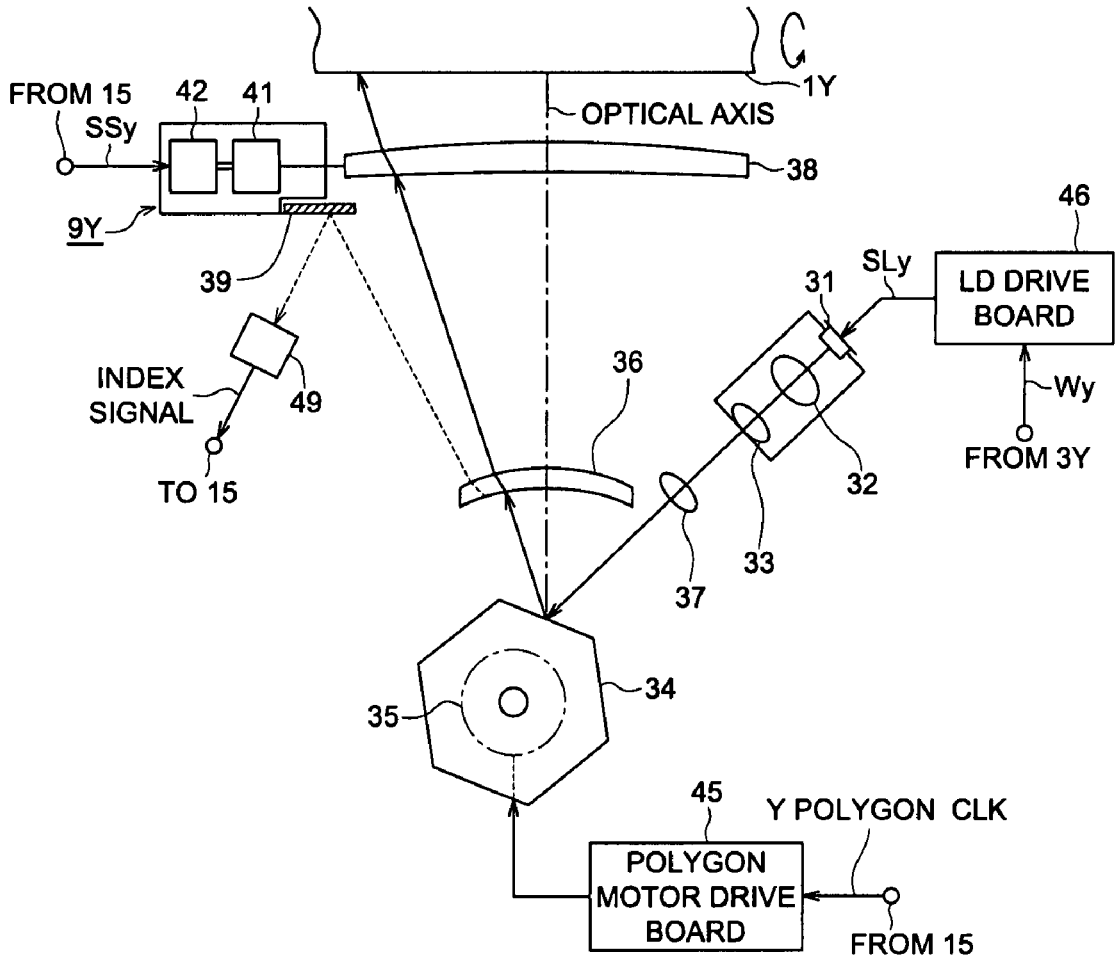
FIG. 7 is a schematic drawing showing an example of the structure writing unit 3Y for color Y and the skew adjustment section 9Y.

FIG. 7 is a schematic drawing showing an example of the structure of the color Y (yellow) writing unit 3Y and the skew adjustment section 9Y. The color Y (yellow) writing unit 3Y shown in FIG. 7 comprises a semiconductor laser light source 31, collimator lens 32, auxiliary lens 33, a polygon mirror 34, a polygon motor 35, f(θ) lens 36, CY1 lens 37 for mirror surface focusing, CY2 lens 38 for drum surface focusing, a reflection plate 39, a polygon motor drive board 45 and an LD drive board 46.

The semiconductor laser light source 31 is connected to the LD drive board 46 for color Y (yellow). The write data Wy from the writing unit 3Y is supplied to the LD drive board 46. When the real time correction mode is carried out, writing data Wy=image data Dy+Dy' is output to the writing unit 3Y. In the normal correction processing of color misregistration, writing data Wy=image data Dy' is output to the writing unit 3Y.

In the LD drive board 46, the writing data Wy is PWM modulated and the laser drive signal SLy of a predetermined panel width that was PWM modulated is output to the semiconductor laser light source 31. Laser light is generated based on the color Y (yellow) laser drive signal SLy in the semiconductor laser light source 31. The laser light irradiated from the semiconductor laser light source 31 is shaped to form a predetermined beam by the collimator lens 32, the auxiliary lens 33 and the CY1 lens 37.

The beam light is deflected in the primary scanning direction by the polygon mirror 34. The polygon mirror 34 may be driven by the polygon motor 35 for example. The polygon motor 35 is connected to the polygon motor drive board 45 and Y polygon CLK is supplied to the polygon motor drive board 45 from the aforementioned controller 15. The polygon motor drive board 45 rotates the polygon motor 35 at a predetermined rotation speed based on the Y polygon CLK. The beam light that was deflected by the polygon mirror 34 is focused toward the photoreceptor drum 1Y by the f(θ) lens 36 and the CY2 lens 38.

The writing unit 3Y has a skew adjustment section 9Y. The skew adjustment section 9Y is mounted to the main body. The main body has the reflection plate 39 and the laser index sensor 49 is mounted at a position which opposes the reflection plate 39. The laser index sensor 49 detects the laser beam deflected by the polygon mirror 34 and the Y-INDEX signal is output to the controller 15.

The skew adjustment section 9Y has an adjustment gear unit 41 and an adjustment motor 42. The adjustment gear unit 41 is mounted to the CY2 lens 38. The adjustment gear unit 41 is mounted so as to be movable with respect to the CY2 lens 38. The adjustment gear unit 42 is adjusted at the adjustment gear unit 41 by being moved in the perpendicular direction based on the skew adjustment signal SSy. It is to be noted that description of the structure of the writing units 3M, 3C and 3K and the skew adjustment section thereof have been omitted.

In this example, the color BK registration mark CR is used color as an example for the color misregistration amount calculation. This is because the image writing units of colors Y, M and C are adjusted so as to match color BK. The adjustment processing may, for example, comprise 5 processes which are (i) to (v) below. Of these correction processes, (i) to (iii) are realized by correcting the image data, while (iv) and (v) are realized by driving the motor 42 and actually adjusting the driving units 3Y, 3M, 3C and 3K by driving.

(i). Primary Scanning Correction Processing

In this processing, the writing positions in the primary scanning direction of the color Y, M, C and BK color images are corrected so as to line up. For example, for color Y (yellow) writing position correction, the mispositioning amount in the primary scanning direction for color Y (yellow) with respect to color BK (black) is obtained from the image detection data Dp for the color BK (black) registration mark CR and the image detection data Dp for the color Y (yellow) registration mark CR, and the correction amount is calculated from the obtained mispositioning amount. The writing timing in the primary scanning direction for colors Y, M and C is adjusted based on this correction amount, the writing position of the other colors Y, M, and C are matched with color BK (black).

(ii). Secondary Scanning Correction Processing

In this processing, the writing positions in the secondary scanning direction of the color Y, M, C and BK color images are corrected so as to line up. For example, for color Y (yellow) writing position correction, the mispositioning amount in the secondary scanning direction for color Y (yellow) with respect to color BK (black) is obtained from the image detection data Dp for the color BK (black) registration mark CR and the image detection data Dp for the color Y (yellow) registration mark CR, and the correction amount is calculated from the obtained mispositioning amount. The writing timing in the secondary scanning direction for colors Y, M and C is adjusted based on this correction amount, and the writing position of the other colors Y, M, and C are matched with color BK.

(iii). Entire Lateral Magnification Processing

This processing is the correction for matching the image forming position in all of color Y, M, C and BK images For example, the image block signal cycle is adjusted and the laser light emission timing is adjusted and the entire lateral magnification displacement amount is adjusted based on this adjustment.

(iv). Partial Lateral Magnification Processing

In this processing, the incline of the horizontal position for the writing units 3Y, 3M, 3C and 3K and the like is adjusted. For example, one horizontal direction of the writing unit 3Y is fixed to the main body and the others are movable and the motor (not shown) is rotated based on the position correction signal Sy in the color Y (yellow) correction section shown in FIG. 7 and the adjusting gear unit 41 is thereby driven. The writing unit 3Y is inclined in the X-Y (horizontal) direction and thereby adjusted. This is for adjusting the incline of the horizontal position of the writing unit 3Y with respect to the photoreceptor drum 1Y. The processing is the same in the other image forming units 10M and 10C.

(v). Skew Correction Section

In this processing is adjustment for correcting the incline of the vertical position of the CY2 lens 38 inside the writing units 3Y, 3M, 3C and 3K. For example, one side of the CY2 lens 38 is fixed so as to be supported by the writing unit 3Y, and the other side is movable up and down. The motor 42 in the color Y (yellow) skew adjustment section 9Y shown in FIG. 7 drives the adjusting gear unit 41 based on the skew adjustment signal SSy and the CY2 lens 38 is adjusted by being moved in the vertical direction. This is for adjusting the incline of the vertical position of the CY2 lens 38 with respect to the photoreceptor drum 1Y. The processing is the same in the other image forming units 10M and 10C.

Figure 8:
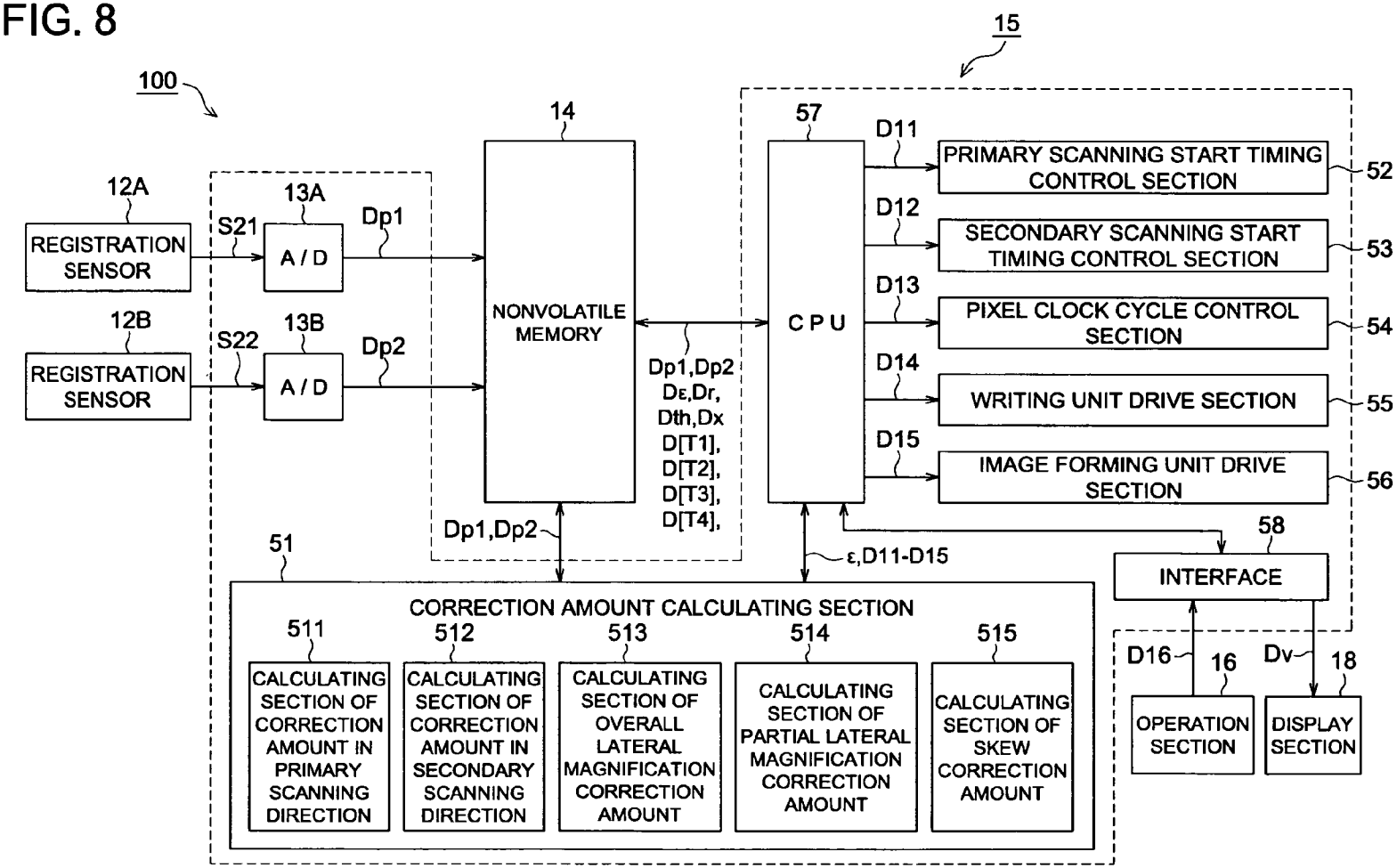
FIG. 8 is a block diagram which supplements an example of the structure of the control system of the color copier 100.

FIG. 8 is a block diagram which supplements an example of the structure of the control system of the color copier 100. The color copier 100 shown in FIG. 8 has registration sensors 12A and 12B, non-volatile memory 14, a controller 15, an operation section 15 and a display section 18.

The controller 15 having a system bus 69, is constituted of AD converters 13A and 13B, correction amount calculating section 51, primary scanning start timing control section 52, secondary scanning start timing control section 53, pixel clock cycle control section 54, writing unit drive section 55, image forming unit drive section 56 and real time color register adjustment control CPU 57, and these are all connected to the system bus 69.

The registration sensor 12A is connected to the A/D converter 13A. In the A/D converter 13A, when the real time correction mode is on, the image detection signal S21 that is output from the registration sensor 12A is subjected to A/D conversion and the image detection data Dp1 that has been made binary is output.

The registration sensor 12B is connected to the A/D converter 13B. In the A/D converter 13B, when the real time correction mode is on, the image detection signal S22 that is output from the registration sensor 12B is subjected to A/D conversion and the image detection data Dp2 that has been made binary is output. The A/D converters 13A-13C respectively are connected to non-volatile memory 14.

In addition to the image detection data Dp1 and Dp2 and the color registration adjustment value Dϵ, elapse time information D[T1], D[T2], D[T3], D[T4] and the like are stored in non-volatile memory 14. Non-volatile memory 14 is connected to correction amount calculating section 51 and the CPU 57. The non-volatile memory 14 may, for example, be divided into memory (area) #1 and #2, and the color registration adjustment value used when the normal operation mode is carried out and the color registration adjustment value used in the first power-on mode are stored in memory #1. The default adjustment value at the time of shipment from the factory is stored in memory #2. In this example, the color registration adjustment value obtained at the time of the first power-on correction mode may be stored in memory #2 and this may be updated.

In addition, the CPU 57 controls the correction amount calculating section 51 and reads the image detection data Dp1 and Dp2 from the non-volatile memory 14 and the color misregistration amount is detected and the primary scanning start timing control section 52, secondary scanning start timing control section 53, the pixel clock cycle control section 54, writing unit drive section 55, and the image forming unit drive section 56 are controlled.

The correction amount calculating section 51 comprises a primary scanning correction amount calculation section 511, a secondary scanning correction amount calculation section 512, an entire lateral magnification correction amount calculation section 513, a partial lateral magnification correction amount calculation section 514, and a skew correction amount calculation section 515. In the correction amount calculating section 51, in the real time correction mode, the image detection data Dp1 and Dp2 are read from the non-volatile memory 14, and the misregistration amount for the error factors (primary scanning, entire magnification, partial lateral magnification, and skewing) are calculated from this image detection data Dp1 and Dp2 and correction amounts are obtained for each error factor by the displacement amount calculated here.

For example, in the primary scanning correction amount calculation section 511, the image detection data Dp1 and Dp2 are read from non-volatile memory 14 and the mispositioning amount in the primary scanning direction is calculated. The timing control data D11 for adjusting the writing timing in the primary scanning direction is output so as to eliminate the mispositioning amount. The mispositioning in the primary scanning direction is corrected by the timing control data D11.

At the secondary scanning correction amount calculation section 512, the image detection data Dp1 and Dp2 are read from non-volatile memory 14 and the amount of mispositioning in the secondary scanning direction is calculated. The timing control data D12 for adjusting the writing timing in the secondary scanning direction is output so as to eliminate the mispositioning amount. The mispositioning in the secondary scanning direction is corrected by the timing control data D12.

At the entire lateral magnification correction amount calculation section 513, the image detection data Dp1 and Dp2 are read from non-volatile memory 14 and the entire lateral magnification displacement amount is calculated. The clock control data D13 for adjusting the wave frequency of the pixel clock signal is output so as to eliminate the entire lateral magnification displacement amount. The entire lateral magnification displacement amount can be corrected by the clock control data D13.

At the partial lateral magnification correction amount calculation section 514, the image detection data Dp1 and Dp2 are read from the non-volatile memory 14 and the partial lateral magnification displacement amount is calculated. The unit control data D14 for adjusting the incline in the horizontal direction of the writing unit 3Y is output so as to eliminate this partial lateral magnification displacement amount. The partial lateral magnification displacement amount can be corrected by the unit control data D14.

At the skew correction amount calculation section 515, the image detection data Dp is read from non-volatile memory 14 and the skew displacement amount calculated. The skew control data D15 for adjusting the incline in the vertical direction of the writing unit 3Y is output so as to eliminate this skew displacement amount. The skew displacement amount can be corrected by the skew control data D15.

Figure 9:
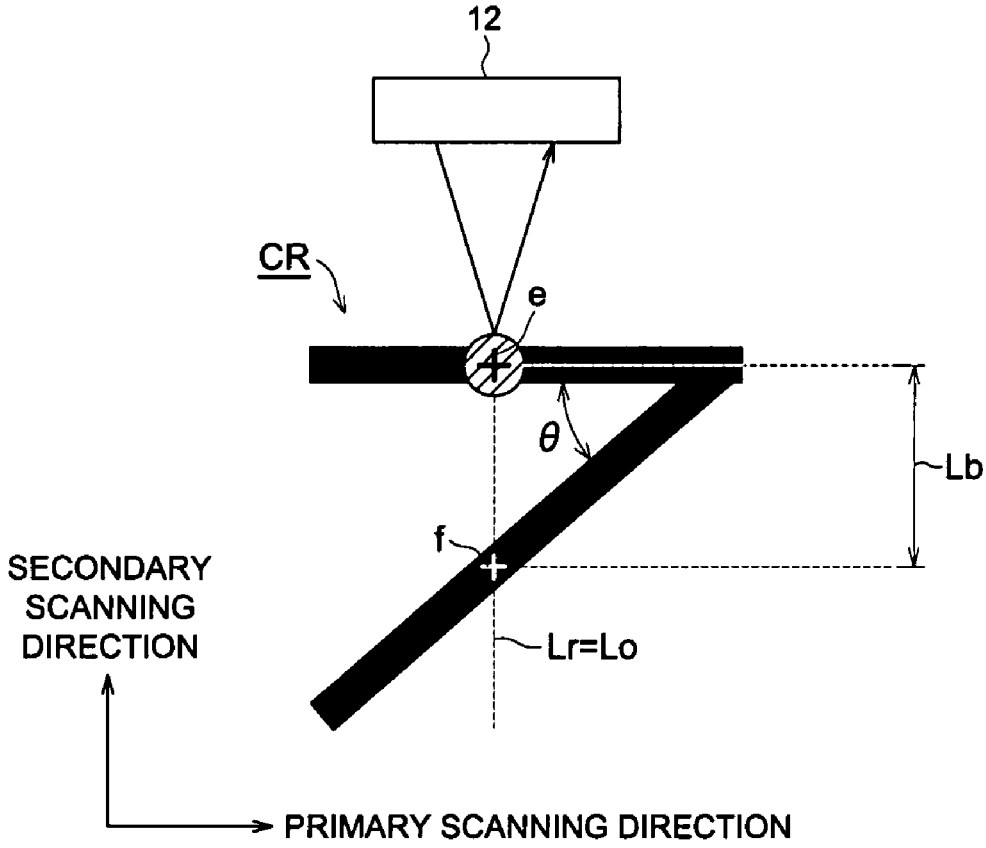
FIG. 9 shows an example of the relationship between the registration mark CR for color misregistration correction and the registration sensor 12.

FIG. 9 shows an example of the relationship between the registration mark CR for color misregistration correction and the registration sensor 12.

The registration mark CR shown in FIG. 9 is used in the real time correction mode or at the time of processing of color misregistration process and it comprises a segment that is parallel to the main scanning direction and a segment that has a angle θ=45° with respect to the primary scanning position. For example, the registration mark CR may comprise the Arabic numeral 7. The registration mark CR is written such that its center point e is included in the radiation position of the spot diameter for the registration sensor 12. The image forming units 10Y, 10M, 10C and 10K are controlled by the CPU 57 shown in FIG. 8 so that registration marks CR are formed on the intermediate transfer belt 6.

In this example, given that a projection line which is parallel to the secondary scanning direction is drawn from the center point "e" of the segment parallel to the primary scanning direction and the point of intersection of the segment with the 45° angle and this projection line is "f", the length of the segment between e-f is Lb. In this example, by calculating the length Lb of the sector e-f from the difference between the detection time of the point "e" and the point "f" of the registration mark CR, the mispositioning in the primary scanning direction with respect to the detection point of the registration sensor 12 for the registration marks CR for color misregistration can be detected.

These registration marks CR for color misregistration are detected by the registration sensor 12 and color misregistration amount for each image forming position of the registration mark CR is calculated and color Y, M and C image forming positions are corrected. This correction is done by correcting the image data Dy, Dm, Dc and Dk for forming color images on the next sheet P in the image forming system after the color misregistration correction mode is carried out, and it is for superimposing the color images based on this color misregistration correction with high accuracy.

FIGS. 10(A)-10(H) show an example of binarization of the image detection signal S21 using the registration sensor 12A and like.

In this example, when the CPU 57 detects the registration mark CR that is formed on the intermediate transfer belt 6, the front end edge detection time and the rear end edge detection time of the registration mark CR on the intermediate transfer belt 6 are detected with the writing start signal as a reference (called VTOP hereinafter) which allows writing of the registration marks CR on the photoreceptor drum 1Y, 1M, 1C and 1K to start, as a reference, and the color misregistration correction data DE is calculated based on the front end edge detection time and the rear end edge detection time of the registration mark CR.

Figure 10:
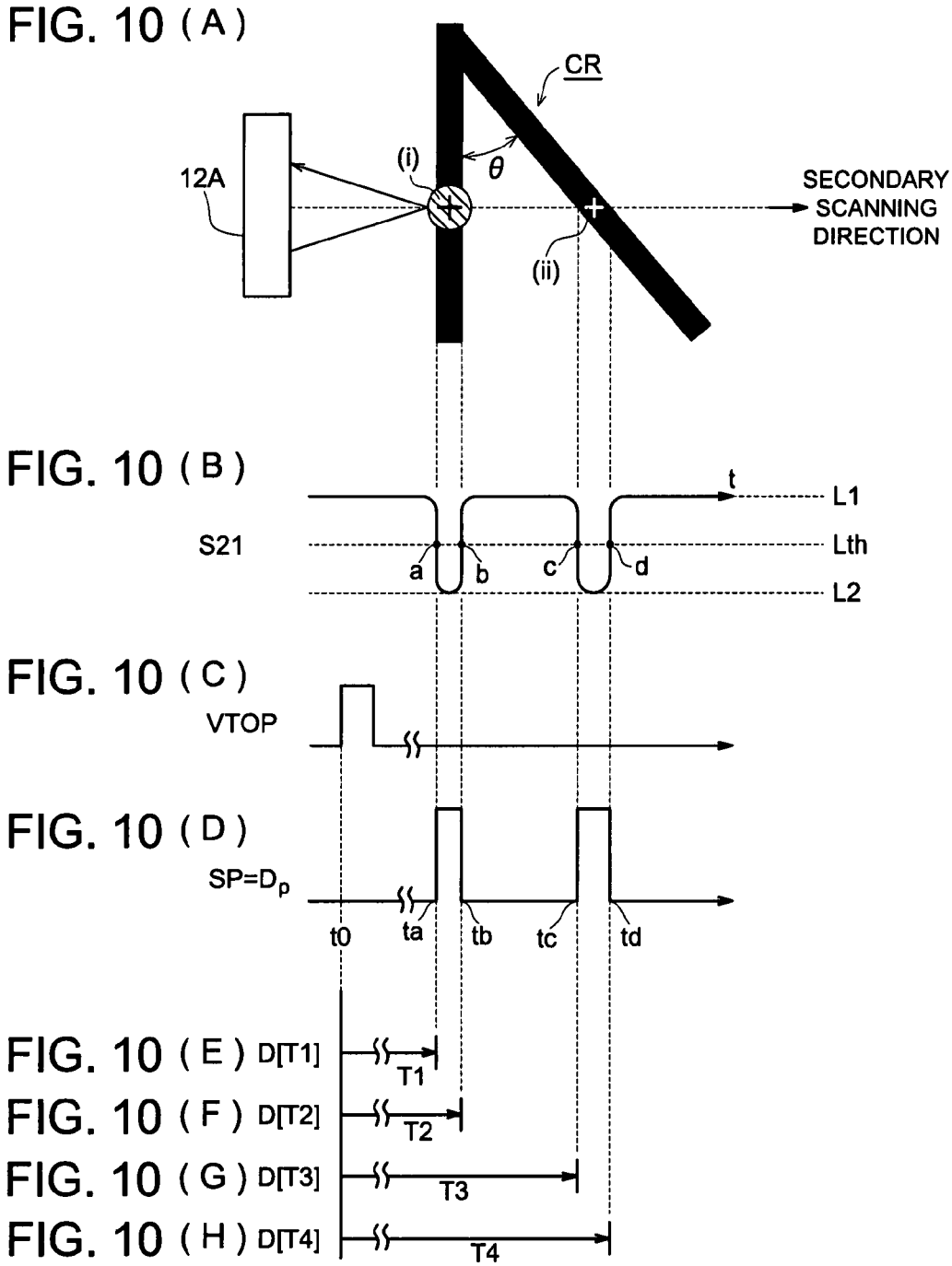

The registration sensor 12A shown in FIG. 10(A) detects the straight line section (i) and the incline section (ii) of the registration mark CR on the intermediate transfer belt 6 and outputs the image detection signal S21. In this example, the angle θ formed by the 7-shaped registration mark CR is 45°. The intermediate transfer belt 6 moves in the secondary scanning direction at a fixed line speed. At the registration sensor 12A, light is irradiated on the registration marks CR from a light emitting element which is not shown and the light reflected therefrom is detected by a light receiving element.

The image detection signal 21 shown in FIG. 10(B) is obtained from the registration sensor 12A and the L1 is the belt (surface) detection level. Lth is the threshold value for making the image detection signal S21 binary and L2 is the mark detection level for the registration mark CR. Point "a" is the point where the front end edge of the registration mark straight line section (i) is detected by the registration sensor 12 and the image detection signal S21 crosses the threshold Lth and it provides the front end edge detection time ta. At this front end edge detection time ta, the first passage timing pulse signal Sp shown in FIG. 10(D) rises.

Point "b" is the point where the rear end edge of the registration mark straight line section (i) is detected in the same manner and the image detection signal S21 crosses the threshold Lth and it provides the rear end edge detection time tb. At this rear end edge detection time tb, the passage timing pulse signal Sp shown in FIG. 10(D) falls.

In the same manner, point "c" is the point where front end edge of the registration mark incline section (ii) is detected by the registration sensor 12 and the image detection signal S21 crosses the threshold Lth and it provides the front end edge detection time tc. At this front end edge detection time tc, the second passage timing pulse signal Sp shown in FIG. 10(D) rises.

Point "d" is the point where the rear end of the registration mark incline section (ii) is detected in the same manner and the image detection signal S21 crosses the threshold Lth and it provides the rear end edge detection time td. At this rear end edge detection time td, the passage timing pulse signal Sp shown in FIG. 10(D) falls. The passage timing pulse signal Sp that has been made binary becomes the image detection data Dp1 and the like. The image detection data Dp1 is used in the displacement position calculation for the writing positions for colors Y, M and C with respect to the writing position of the color BK registration mark CR.

The width of the mark in the secondary scanning direction for the registration mark straight line section (i) is obtained based on the elapse time T2 shown in FIG. 10(F) and the elapse time T1 shown in FIG. 10(E) in the case where the intermediate transfer belt 6 is moved at a fixed line speed in the secondary scanning direction. The elapse time T1 is obtained when the write start signal (VTOP signal) rises at the time tO which is shown in FIG. 10(C), by the counter which is not shown being started up and then counting the number of pulses of the reference clock signal and when the front end edge detection time ta is reached, it is the output value (elapse time information D[T1]) output from the counter.

The VTOP signal is the signal (image front end signal) which permits writing of the registration marks CR on the photoreceptor drums 1Y, 1M, 1C and 1K. Similarly, the elapse time T2 is obtained by the counter further counting the number of pulses of the reference clock signal and when the rear end edge detection time tb is reached, it is the output value (elapse time information D[T2]) output from the counter. These elapse time information D[T1] and D[T2] are stored in non-volatile memory 14.

When color misregistration is to be calculated, the elapse time information D[T1] and D[T2] are read from the non-volatile memory 14. In the controller 15, the mark width in the secondary scanning direction of the registration mark straight line section (i) is calculated using (T2-T1) based on elapse time information D[T1] and D[T2].

In addition, the mark width in the secondary scanning direction of the registration mark incline line section (ii) is provided based on elapse time T4 shown in FIG. 10(H) and elapse time T3 shown in FIG. 10(G). The elapse time T3 is obtained when the VTOP signal rises at the time to which is shown in FIG. 10(C), by the counter being started up and then counting the number of pulses of the reference clock signal and when the front end edge detection time t0 is reached, it is the output value (elapse time information D[T3]) output from the counter.

Similarly, the elapse time T4 is obtained by also counting the number of pulses of the reference clock signal and when the rear end edge detection time tb is reached, it is the output value (elapse time information D[T4]) output from the counter. These elapse time information D[T3] and D[T4] are stored in non-volatile memory 14.

When color misregistration is to be calculated, the elapse time information D[T3] and D[T4] are read from the non-volatile memory 14. In the controller 15, the mark width in the secondary scanning direction of the registration mark incline section (ii) is calculated using $\sqrt{2}\times(T4-T3)/2$ based on elapse time information D[T3] and D[T4]. The information obtained from the calculations becomes the color misregistration correction data. It is to be noted that when carrying out the first power-on correction mode, the registration marks CR are formed on both sides of the intermediate transfer belt 6 and these are detected by the two registration sensors 12A and 12B.

Embodiment 1

Figure 11:
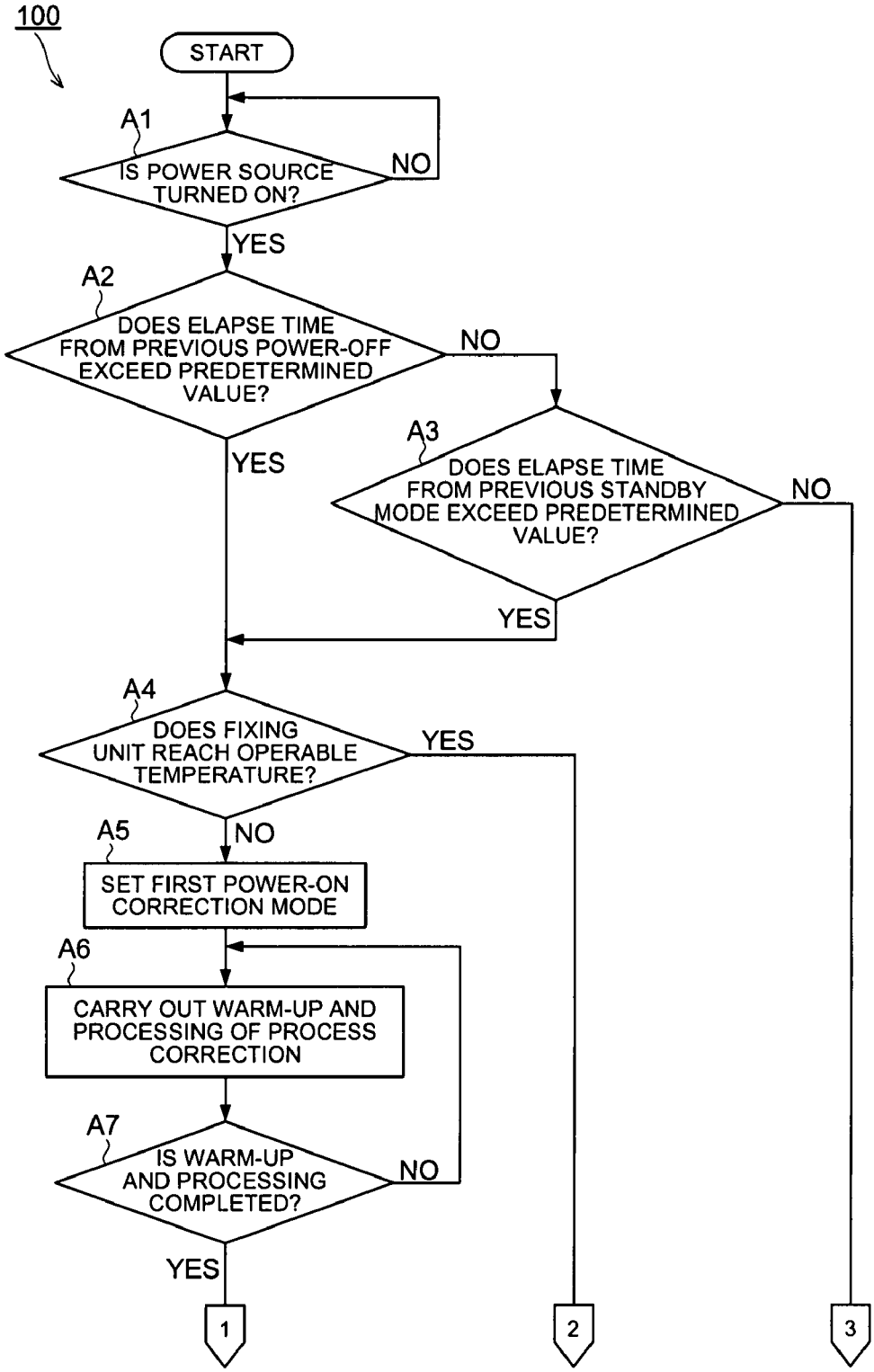
FIG. 11 is a flowchart showing an example of color misregistration correction (part 1) including the first power-on correction mode of the color copier 100 as the first embodiment.
Figure 12:
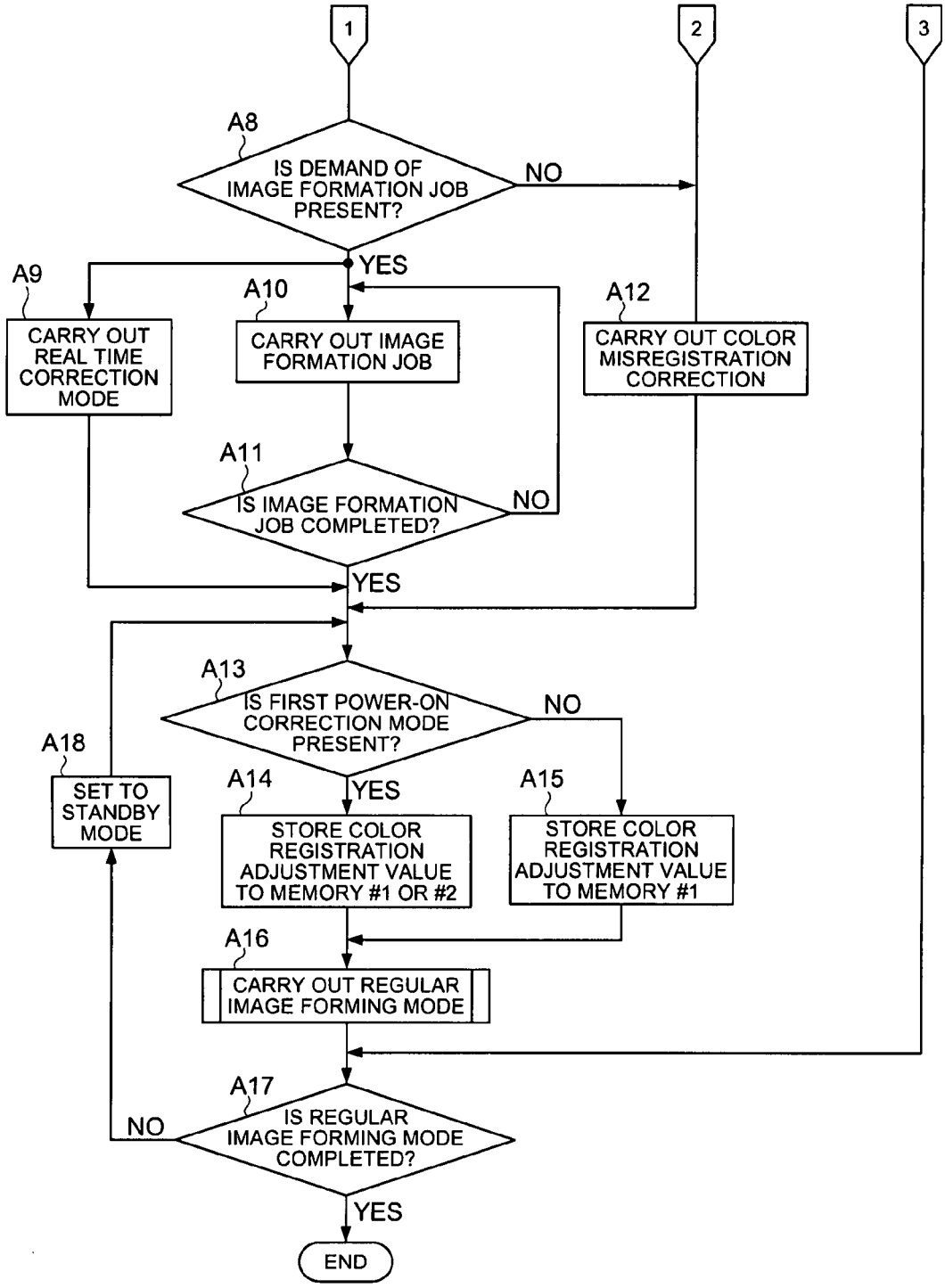
FIG. 12 is a flowchart showing an example of the color misregistration correction (part 2) including the first power-on correction mode.
Figure 13:
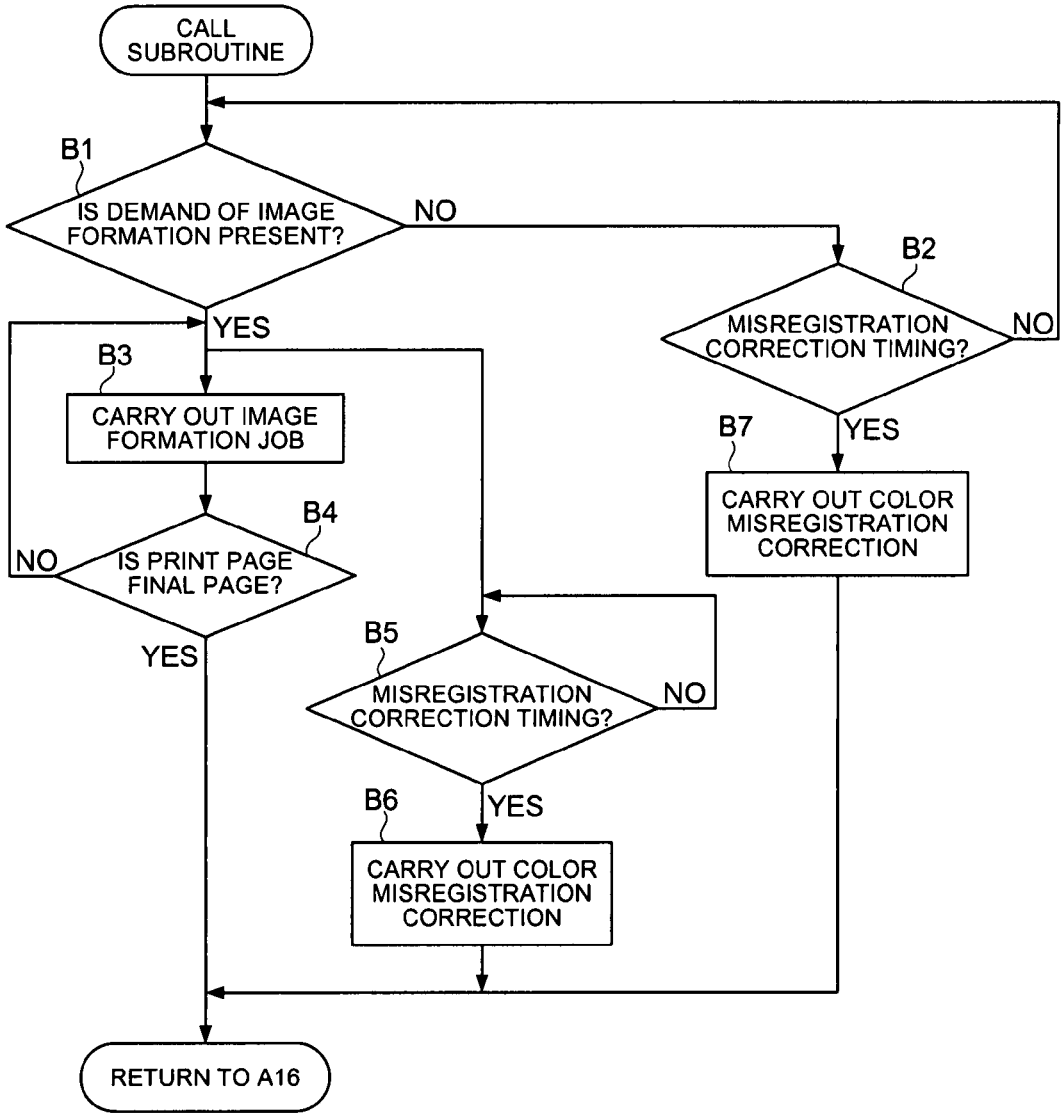
FIG. 13 is a flowchart showing an example in the regular operation mode.

Next an example of the operation of the color copier 100 will be described. FIG. 11 and FIG. 12 are flowcharts showing an example (part 1 and part 2) of color misregistration correction including the first power-on correction mode of the color copier 100 as the first embodiment. FIG. 13 is a flowchart showing an example in the regular operation mode.

The copier 100 of this embodiment comprises at least a power source for the image forming section 80 and a power source control section 85 which controls power source and the like for sections other than the image forming section 80. In this example, when the power source switch 83 is turned on, the controller 15 that is connected to the power source control section 85 sets the first power-on mode based on the power-on information, the first and second elapse time information and the fixing temperature information. In each type of process correction at first power-on, the priority level for correction of color misregistration (color registration correction) processing is set to be lowest and correction of color misregistration is performed last in the correction sequence. In addition, in the correction of color misregistration processing, real time correction mode is carried out. The controller 15 carries out correction of color misregistration for sheet units.

These color misregistration correction conditions including the first power-on correction mode are set and in Step A1 shown in the flowchart in FIG. 11, the power source control section 85 detects power-on. For example, as shown in FIG. 2, the power-on detector 82 detects the on operation of the power source switch 83 and the power-on signal S82 (power-on information) is output to the controller 15.

Next in Step A2, the control section 15 determines whether the time from power-off to when power-on is reached exceeds a predetermined time. At this time, the control section 15 obtains first elapse time information (elapse time from power-off time to power-on time) from the current output value of the timer that was started up at the previous power-off time until power-on. The controller 15 compares the first elapse time information with a preset elapse time determination value. If the elapse time to power-on is less than a predetermined value the procedure goes to Step A3.

In Step A3, a determination is made as to whether the second elapse time information from transition to standby mode to power-on exceeds a predetermined value. At this time, the control section 15 obtains second elapse time information (elapse time from power-on) from the current output value of the timer that was started up at transition to the previous power-on. The controller 15 compares the second elapse time information with a preset elapse time determination value (predetermined value). If the elapse time to power-on exceeds a predetermined value the procedure goes to Step A17.

If the first elapse time information in Step A2 above exceeds the predetermined value, the procedure goes to Step A4. In Step A4, the controller 15 determines whether the fixing temperature in the fixing unit 17 reaches an operable fixing temperature. For example, at the controller 15 the fixing temperature signal S27 is input from the temperature sensor 27. The controller 15 compares the preset fixing temperature target value with measured value for the temperature based on the fixing temperature signal 27 and thereby determines whether the fixing unit 17 has reached the operable fixing temperature. If the fixing unit 17 has reached the operable fixing temperature (YES), the procedure goes to Step A12.

If the fixing unit 17 has not reached the operable fixing temperature (NO), the procedure goes to Step A5 and the controller 15 sets the first power-on mode. For example, the controller 15 sets the first power-on correction mode (process correction mode) based on the power-on signal S82 output from the power-on detector 82, the fixing temperature signal S27 output from the temperature sensor 27 and the first and second elapse time information and the priority level for carrying out correction processing of color misregistration is set to be lowest. The priority ranking is set to the lowest rank in order to carry out correction processing of color misregistration last.

The procedure then goes to Step A6 and the controller 15 performs warm-up and correction process of processing. For example, the controller 15 applies a predetermined voltage to the fixing unit 17 and thereby performs controls the fixing temperature to be increased. Subsequently, in Step A7, the controller 15 determines whether the warm-up and correction process of processing are complete. At this time, the controller 15 is input the temperature detection signal S27 from the temperature sensor 27 and compares the temperature control data and the control temperature value to determine whether fixing temperature is reached. The controller 15 accepts image formation jobs at the point where, of the various correction process of processing, correction processing other than correction processing of color misregistration is complete.

In Step A8 in flowchart shown in FIG. 12, the controller 15 separates control according to whether an image formation job request is present or not. If an image formation job request is present (YES), the procedure goes to Step A9 and Step A10 and parallel processing is carried out at the image processing section 80. In Step A9, the image processing section 80 carries out the real time correction mode. In the real time correction mode, the image processing section 70 is controlled such that the registration marks CR are written on the non-image areas of widths W21 and W2*r*.

At this time, the controller 15 outputs image control signals S4 and writing control signals S5 to the image forming section 80 and image formation control is thereby carried out. The image processing circuit 71 outputs image data Dy' for color misregistration correction based on the image processing control signal S4 to the Y-signal processing section 72Y. Similarly, the image processing circuit 71 outputs image data Dm' for color misregistration correction to the M-signal processing section 72M; outputs image data Dc' for color misregistration correction to the C-signal processing section 72C; and outputs image data Dk' for color misregistration correction to the K-signal processing section 72K.

The image forming section 80 performs image formation job in Step A10 in parallel with this. At this time, the image forming section 70 is controlled such that images are written on the image area of width W1. The controller 15 outputs an image processing control signal S4 and a writing control signal S5 to the image forming section 80 and image formation control is thereby carried out. In the image processing circuit 71, R, G and B signals are subjected to color conversion based on the image processing control signal S4 and the image data Dy is output to the Y signal processing section 72Y. Similarly, the image processing circuit 71 outputs image data Dm to the M-signal processing section 72M, image data Dc to the C-signal processing section 72C and image data Dk to the K-signal processing section 72K.

The Y-signal processing section 72Y combines the image data Dy and the image data Dy' based on the writing control signal S5 and outputs the image data Dy and the image data Dy' to the writing unit 3Y. The writing unit 3Y detects the radiation timing for the color Y laser light and outputs the laser detection signal (called Y-INDEX signal hereinafter). The other signal processing sections which are the M-signal processing section 72M, the C-signal processing section 72C and the K-signal processing section 72K operate in the manner and so descriptions thereof have been omitted.

In this example, when the real time correction mode in Step A9 and Step A10 is carried out, the writing data Wy which is equal to the image writing data Dy plus the image writing data Dy' is output to the writing unit 3Y. That is to say, the normal image data Dy for image formation that is to be written on the image area of width W1 and the image data Dy' for color misregistration correction that is to be written on the width W2 and W2*r* of the both ends which is non-image area are serially combined at the Y-signal processing section 72Y and then output to the writing unit 3Y. The operation for the other writing units 3M, 3C and 3K are the same and thus descriptions thereof have been omitted.

It is to be noted that the real time correction mode and the image formation job sometimes end at the same time, and also correction processing of color misregistration in the real time mode sometimes ends early, and also the image formation job sometimes ends earlier than the correction process of color misregistration.

In Step A11, the controller 15 determines the end of the image formation job. For example, the end of flag (EOF) included in the image data is detected and last page is recognized. When the last page is detected, the process goes to Step A13. If the last page is not detected, the process returns to Step A10 and the foregoing processing is repeated.

In the Step A8 if there is no image formation job request (NO), the procedure goes to Step A12 and correction processing of color misregistration is carried out independently. At this time, the image processing circuit 71 outputs writing data Wy which is equal to image data Dy' to the writing unit. Writing data Wm which is equal to image data Dm', writing data Wc which is equal to image data Dc', and writing data Wk which is equal to image data Dk' are output to the other writing units 3M, 3C and 3K respectively.

In the writing units 3Y, 3M, 3C and 3K, the registration marks CR for color misregistration correction are controlled by the controller 15 so as to be formed on the intermediate transfer belt 6 via the photoreceptor drums 1Y, 1M, 1C and 1K. In this example, when the controller 15 is to detect the registration mark CR formed on the intermediate transfer belt 6, it detects the registration mark CR on the intermediate transfer belt 6 with the writing start signal as a reference (called VTOP hereinafter) which allows writing of the registration marks CR on the photoreceptor drum 1Y, 1M, 1C and 1K to start, and the color misregistration correction data (color registration adjustment value) Ds is calculated. Next the procedure goes to Step A13.

In Step A13, memory control is divided based on first power-on correction mode or normal correction processing of color misregistration. In the first power-on correction mode, in the case where the color registration adjustment value is obtained, the procedure goes to Step A14 and the color registration adjustment value is stored in the non-volatile memory 14. The color registration adjustment value used in the first power-on mode is stored in memory #2 for example. The default adjustment value at the time of shipment is stored in memory #2. The color registration adjustment value used when the normal operation mode is carried out is stored in memory #1. Subsequently, the procedure goes to Step A16.

In the case where color registration adjustment value is obtained in the normal correction processing of color misregistration, the procedure goes to step A15 and then the color registration adjustment value is stored in memory #1. Subsequently, the procedure goes to Step A16 and the normal operation mode is carried out. As a result, at the point where the correction processing of color misregistration that was carried out last is completed, the copy and print (image formation job) is accepted and printing (image creation) operation can begin.

For example, in Step B1 where the subroutine in FIG. 13 is called, the controller 15 puts the image formation job requests on standby in the normal operation mode. In the case where there is no image formation job request, the procedure goes to Step B2 for example, and monitoring is done periodically to determine whether the time for correction processing of color misregistration has been reached. If the time for correction processing of color misregistration has not been reached, the process returns to Step B1 and the standby processing is continued. At this time, the control section 15 carries out the standby mode. In the case where there is an image formation job request, the procedure goes to Step B3 and the image formation job is performed. For example, the controller 15 outputs the image processing control signal S4 and the writing control signal S5 to the image forming section 80 and image formation control is thereby carried out (see Step A11).

In Step B4, the controller 15 determines whether the print page for the current image formation job is the last page. The controller 15 detects the end of flag (EOF) that is included in the image data and the last page is thereby recognized. In the case where the last page is detected, the procedure returns to Step A16. If the last page is not detected, the procedure returns to Step B3 and the foregoing processing is repeated. Monitoring to determine whether the time for correction processing of color misregistration has been reached is done in parallel with the foregoing image formation job in Step B5 also. In addition, while the image formation job is being carried out, if the time for correction processing of color misregistration has been reached, real time correction processing is carried out in Step B6 (see step A9). Subsequently, the procedure returns to Step A16.

If the time for correction processing of color misregistration is reached in Step B2, the procedure goes to Step B7 and correction processing of color misregistration is carried out independently (Step A12). Subsequently the procedure returns to Step A16. The procedure then goes to Step A17 and end determination is done. For example, the controller 15 detects the power-on information and goes to the power saving mode. When the power source switch 83 is turned off, power-off information is output from the power source control section 85 to the controller 15 and the power-on mode is cancelled and a transition is made to the power saving mode. In the power saving mode, power supply to the image forming section 80 may be cut and power required for minimum operation is supplied other load circuit 90 such as the time function, the CPU function, the monitor display function and the communication function (fax) and the like.

In the case where the power-off information is not detected, the controller 15 sets the image forming section 80 to the standby mode at the Step A18 and the procedure returns to Step A13. In the standby mode for example, the power saving control signal S80 is output to the image forming section 80 from power source control section 85. In the image forming section 80, the fixing temperature of the fixing unit 17 may be reduced based on the power saving control signal S80 and power consumption is thereby controlled so as to be reduced.

In Step A13, control is divided according to where the color registration adjustment value obtained in the subroutine in FIG. 13 is stored. In this example, normal correction processing of color misregistration other than the first power-on mode is carried out to obtain the color registration adjustment value and thus the procedure goes to Step A15 and the color registration adjustment value is stored in memory #1. Subsequently, the procedure goes to Step A16 and the normal operation mode is carried out. As a result, power-on and the correction processing of color misregistration including the first power-on mode can be carried out.

In this manner, according to the color copier 100 of the first embodiment, correction processing of color misregistration and correction process of processing other than the correction processing of color misregistration are carried out and the power-on detector 82 detects the "ON" state of the power source switch 83. The temperature sensor 27 detects the fixing temperature in the fixing unit 17 and the fixing unit temperature signal S27 is output to the controller 15.

Based on this, the controller 15 sets the first power-on correction mode based on the power-on detection signal S82 output from the power-on detector 82, fixing temperature signal S27 output from the temperature sensor 27, and the priority level for executing the correction processing of color misregistration is set to be the lowest.

Thus, when the correction processing of color misregistration in the image forming section 80 other than warm-up plus correction process of processing is complete, the correction processing of color misregistration is carried out absolutely last. Also, because the real time correction mode can be carried out in parallel with the image formation job, the wait time for the user is shortened.

In the above embodiment, the case where the first power-on correction mode is set at power-on based on the power-on detection signal S82, fixing temperature signal S27, and the first and second elapse time information has been described but other cases are possible and the first and second elapse time information may be excluded from the items of control. When the first elapse time information is excluded from the items of control, the means for measuring the elapse time from the previous power-off may be omitted. In addition, when the second elapse time information is excluded from the items for control, the means for measuring the elapse time from transition to the standby mode to the current power-on can be omitted. The load on the CPU installed in the controller 15 can thereby be reduced significantly.

In the case where the process correction mode is set based on fixing roller surface temperature monitor, when the power is off, for example, the elapse time from the previous power-off to the current power-on and the control target time are compared and if the elapse time is greater than the control target time, and the fixing temperature is less than the predetermined temperature, the first power-on correction mode may be set.

Embodiment 2

Figure 14:
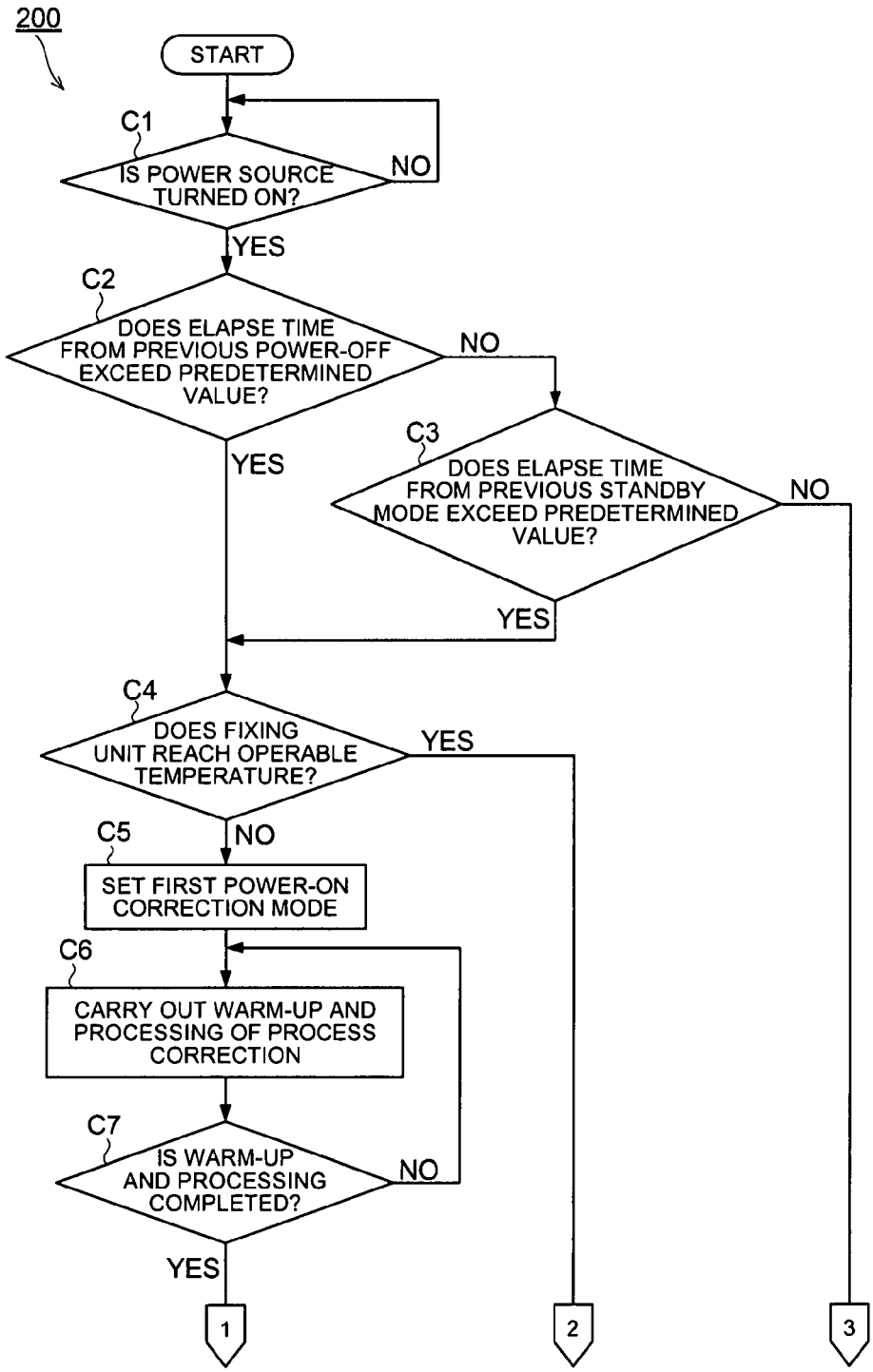
FIG. 14 is a flowchart showing an example of the color misregistration correction (part 1) including the first power-on correction mode for the copier 200 of the second embodiment.
Figure 15:
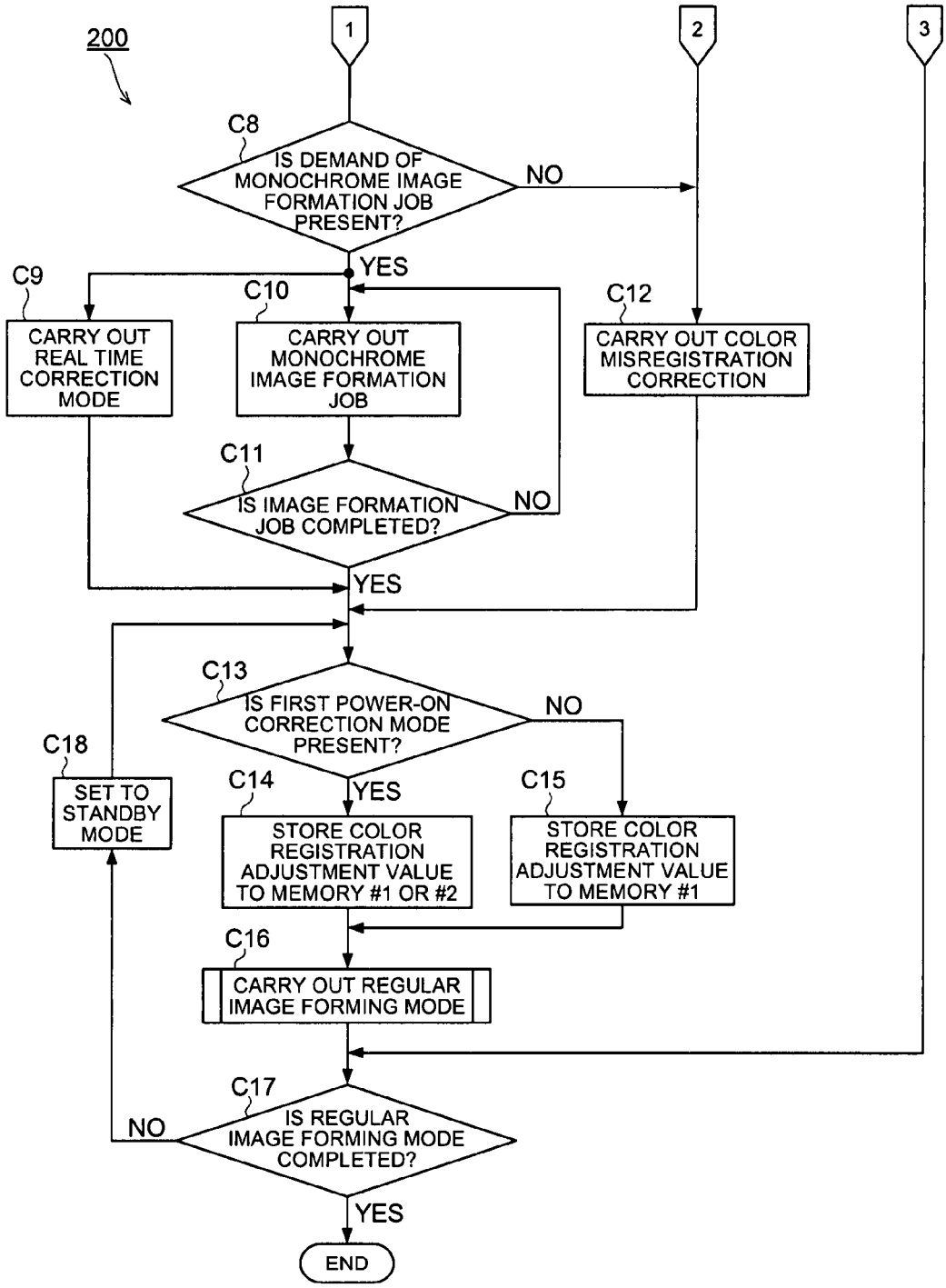
FIG. 15 is a flowchart showing an example of the color misregistration correction (part 2) including the first power-on correction mode.

FIG. 14 and FIG. 15 are flowcharts showing examples of the color misregistration correction (1 and 2) including the first power-on correction mode for the copier 200 of the second embodiment.

In this example, as is the case of the first embodiment, the copier 200 comprises a power source controller 85 and if the first power-on mode is set in Step C5 via Steps C1-C4 of the flowchart shown in FIG. 14, the process correction modes other than the correction processing of color misregistration of the image forming section 80 is carried out, and after the correction processing is complete in Step C7, only monochrome image formation jobs are accepted in Step C8 and subsequently the printing operations related to the monochrome image formation job begin in Step C10.

It is to be noted that the copier 200 employs the same structure as the copier 100 shown in the first embodiment and thus a description thereof has been omitted. Comparing Steps A1-A18 of the flowchart in the first embodiment shown in FIG. 11 and FIG. 12 with Steps C1-C18 of the flowchart in the second embodiment shown in FIG. 14 and FIG. 15 show a difference in Step C10 where the printing operation for the monochrome image formation job begins. The other processing is the same as that of the first embodiment and thus a description thereof has been omitted. The processing of Steps C1-C18 uses the Steps of A1-A18.

In this manner, according to the example of color misregistration correction of the color copier 200, at the point where correction other than color registration correction at the time of the first power-on mode is complete, only monochrome copy or print job (monochrome facsimile output job) is accepted, and subsequently the printing operation begins. Thus by performing only the monochrome image formation job, color image deterioration is avoided that occurs when shortening the wait time in the case where the color image formation job is accepted.

Embodiment 3

Figure 16:
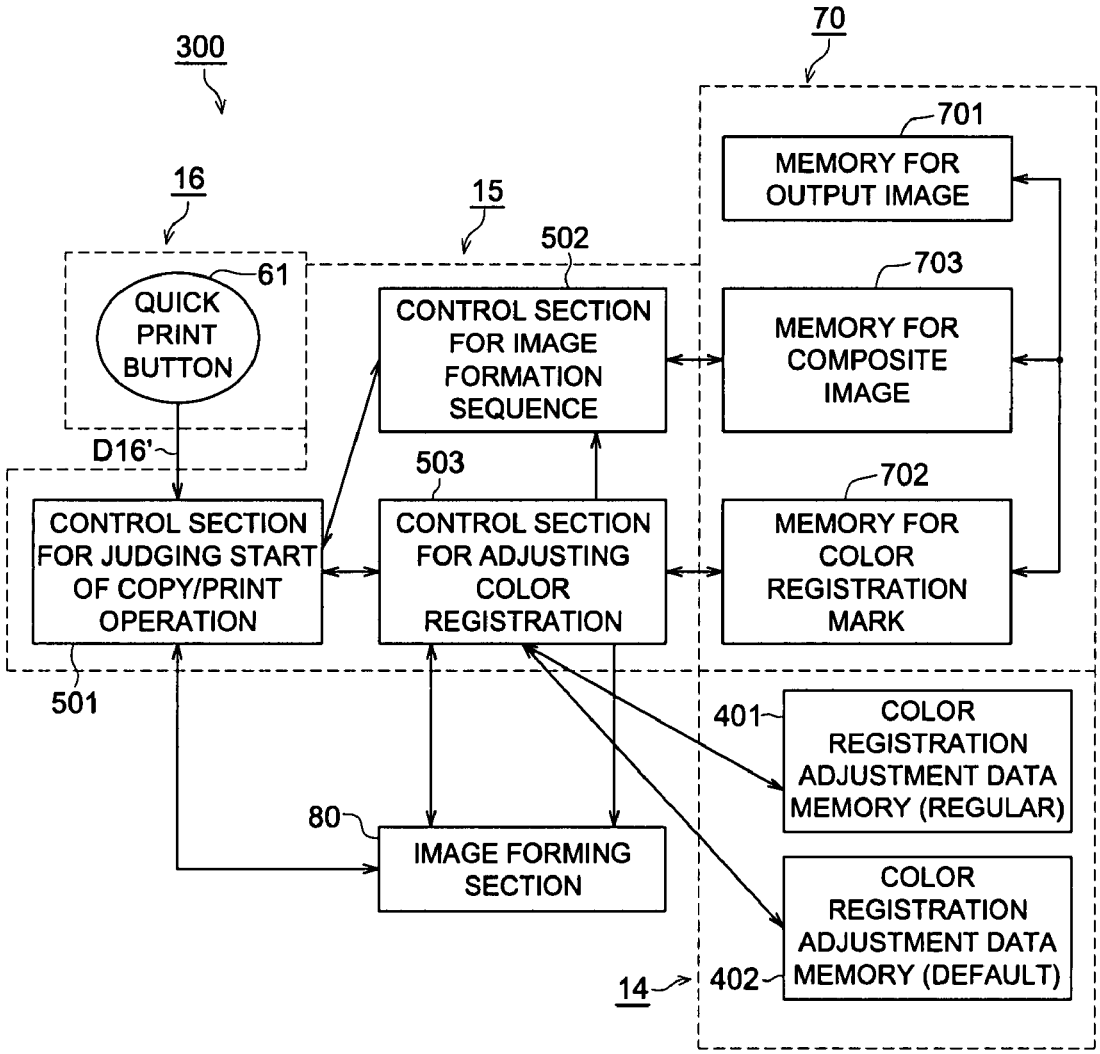
FIG. 16 is a block diagram showing an example of the structure of the color copier 300 which is the third embodiment.

FIG. 16 is a block diagram showing an example of the structure of the color copier 300 which is the third embodiment. In this embodiment, the copier 300 includes a power source control section 85 as is the case in the first and second embodiments and it further includes a selector. When the user turns on the power source switch 83, the user may select whether priority will be given to "wait time" or "image quality".

The color copier 300 shown in FIG. 16 is one example of the structure of an image forming apparatus and the copier 300 is provided with; a quick print button (called QP button 61 hereinafter); color registration adjustment data memory 401 (normal); color registration adjustment data memory 402 (default); a copy and print operation start determination controller 501; an image creation sequence controller 502; a color registration adjustment controller 503; output image memory 701; color registration mark memory 702; and synthesized image memory 703.

The QP button 61 is one example of the selector and it selects the quick image formation mode (quick print mode: called QP mode hereinafter) in which the image formation job is carried out that is accepted after correction processing in the first power-on correction mode other than the correction processing of color misregistration for the image forming section 80 ends. The QP mode is one in which, because the "wait time" is shortened, the type of image formation jobs are accepted in which the first image is allowed even if image quality deteriorates. The QP button 61 is set by operation section 16 shown in FIG. 3.

In this example, when the user presses the QP button 61, the QP mode is selected and the QP mode is set. When the QP mode is set, the operation data D16' is output to the controller 501. This operation is performed by the user. Based on the operation data D16', the controller 501 accepts an image formation job at the point where warm-up and process corrections other than correction processing of color misregistration is complete, and the printing operation can start based on the previous color registration adjustment data read from the non-volatile memory 14 or the default value.

In this example, in the case where the QP mode is not selected, after all the correction processing in first power-on mode including the correction processing of color misregistration is completed, the image formation job is received and subsequently the printing operation for the image formation job starts. Of course, this is not the only possible case, and in the case where the QP mode is not selected, after all the correction processing in first power-on mode including the correction processing of color misregistration is completed, as is the case in the second embodiment, the monochrome image formation job is accepted and subsequently the printing operation for the image formation job may start.

The controllers 501-503 are examples of the controller 15 shown in FIG. 3. The controller 501 determines starting of the copy or print operation using a control sequence program and the controller 502 controls the image forming section 80 using the image formation sequence program. The control section 503 performs color registration adjustment processing using the color registration correction sequence program (see the first embodiment).

The memory 401 and 402 may, for example, comprise the non-volatile memory 14 shown in FIG. 3 and is loaded in the image processing section 70. The memory 401 stores the image data Dy, Dm, Dc and Dk for image formation output in the normal operation mode. The memory 402 stores the image data Dy', Dm', Dc' and Dk' for the color registration mark.

The synthesized image memory is the memory which is loaded in the Y signal processing section 72Y, the M-signal processing section 72M, a C-signal processing section 72C, and a K-signal processing section 72K. For example, in the Y-signal processing section 72Y, when the real time correction mode is carried out, the image data Dy' for color misregistration correction and the image data Dy based on the image processing control signal S4 are synthesized. FIG. 3 can be referred to for the other functions.

In the case where the color copy job is started before the correction processing of color misregistration ends, as the printing operation is based on the previous color registration adjustment data, it can be expected that the accuracy of the color registration adjustment may drop. Thus the QP button is included to compensate for this since the copy start time at power-on can be shortened, and a small amount of image deterioration is permitted.

Figure 17:
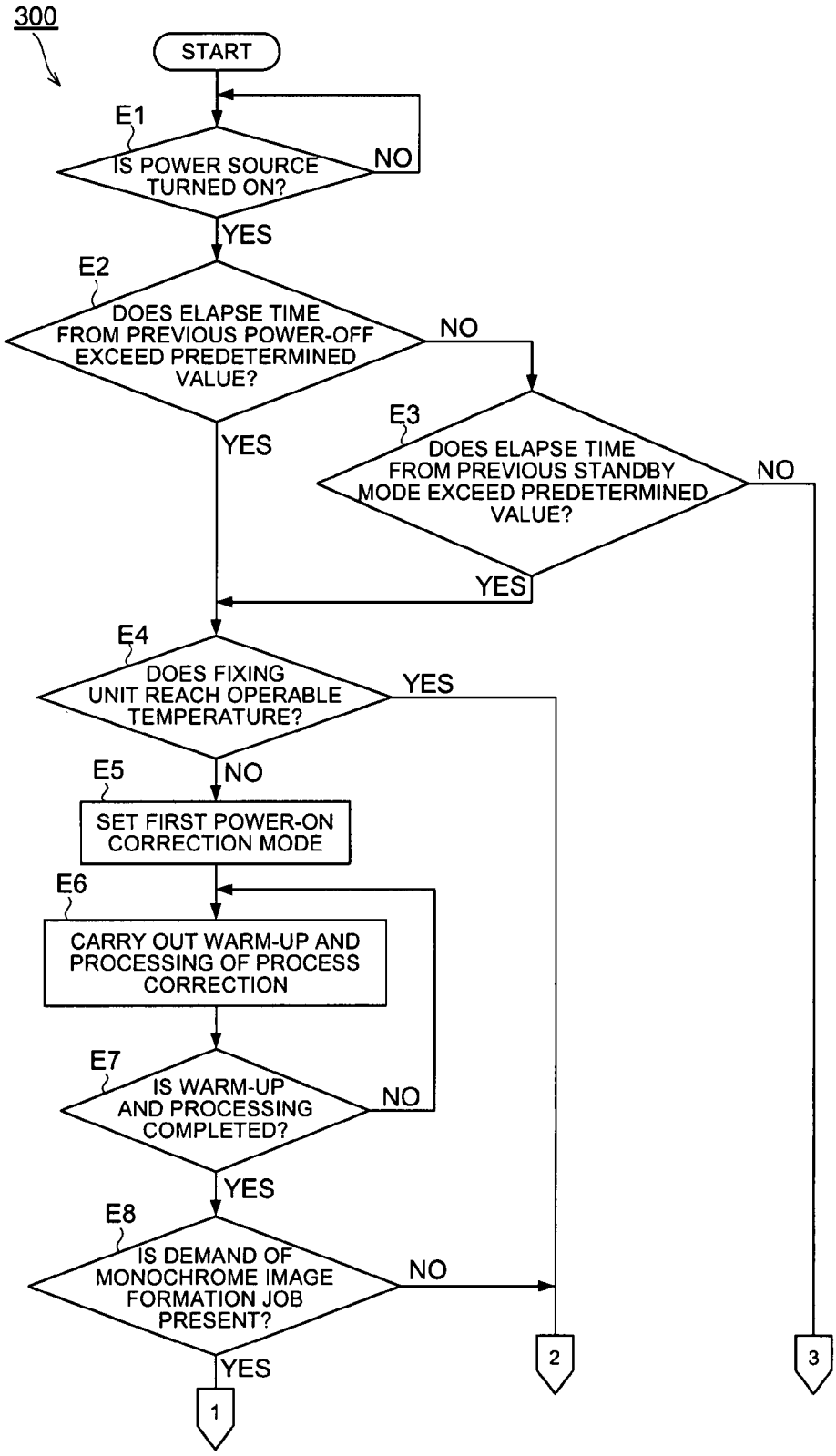
FIG. 17 is a flowchart showing an example of the color misregistration correction (part 1) including the first power-on correction mode as the third embodiment.
Figure 18:
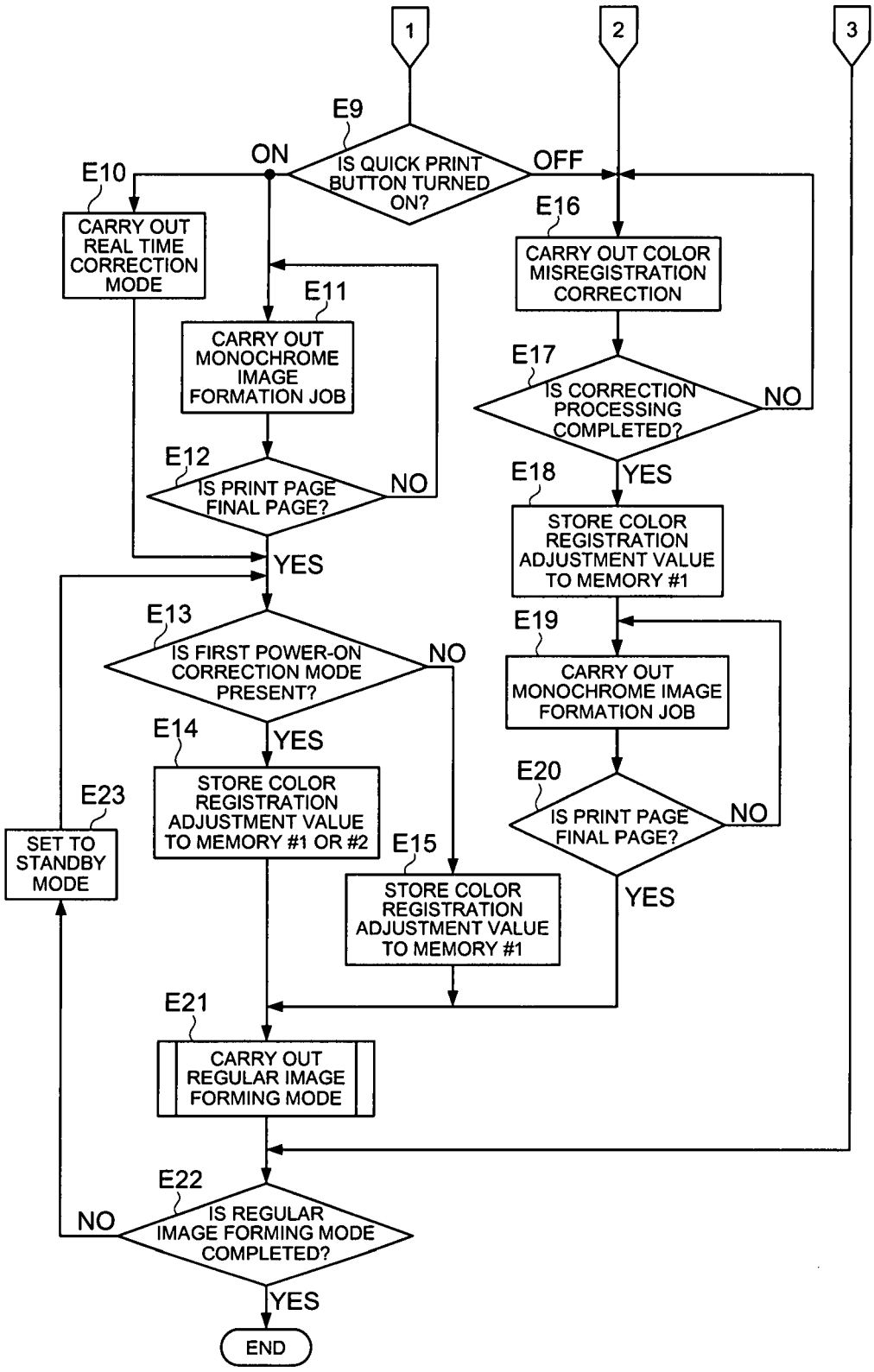
FIG. 18 is a flowchart showing an example of the color misregistration correction (part 2) including the first power-on correction mode.

Next, an example of the operation of the color copier 300 will be described. FIG. 17 and FIG. 18 are flowcharts showing examples of color misregistration correction (1 and 2 respectively) including the first power-on correction mode as the third embodiment.

In the color copier 300 of this embodiment, it can be expected that the accuracy of color registration adjustment will decrease in the case where the color copy job is started before correction processing of color misregistration ends, because the color registration adjustment data previously obtained is used. Thus the QP button is included to compensate for this since the copy start time at power-on can be shortened, and a small amount of image deterioration is permitted.

These are the color misregistration correction conditions which include the first power-on correction mode, and the power-on controller 85 detects power-on in Step E1 of the flowchart shown in FIG. 17. Next, in Step E2, the controller 15 determines whether the elapse time from the previous power-off to the current power on exceeds the predetermined value. At this time, the controller 15 obtains the first elapse time information (elapse time from power-off to power-on) from the current output value of the timer that was started at the previous power-off. The controller 15 compares the first elapse time information with the preset elapse time determination value (predetermined value). If the elapse time until power-on is less than the predetermined value the procedure moves to Step A3.

In Step E3, a determination is made as to whether the second elapse time information from transition to standby mode to power-on exceeds a predetermined value. At this time, the control section 15 obtains second elapse time information (elapse time until power-on) from the current output value of the timer that was started up at transition to the previous standby mode. The controller 15 compares the second elapse time information with a preset elapse time determination value (predetermined value). If the elapse time to power-on is less than the predetermined value the procedure goes to Step E22.

If the first elapse time information in Step E2 above exceeds the predetermined value, the procedure transitions to Step E4. In Step E4, the temperature sensor 27 detects the fixing temperature and subsequently the controller 15 sets the first power-on correction mode in Step E5. Next in Step E6, the controller 15 carries out warm-up and correction process of processing. In Step E7, the controller 15 determines whether the warm-up and correction process of processing are complete. If the warm-up and correction process of processing are complete, in Step E8, the controller 15 separates control according to whether a monochrome image formation job request is present or not. Up until this point the process is the same as in the second embodiment.

The difference from the second embodiment is that in the case where a "monochrome image formation job request is present" the procedure moves to Step E9 shown in FIG. 18 and control is divided based on whether the QP button has been pressed. In the case where the QP button has been turned on, the procedure goes to Steps E10 and E11 and parallel processing is performed in the image processing section 80. In Step E10, the real time correction mode is carried out (Step A9 in FIG. 12).

In Step E11, in the image forming section 80, the monochrome image formation job is carried out in parallel in the same manner as the second embodiment. In this example, in Step E10 and E11, the real time correction mode and the image formation job are carried out simultaneously (See Steps A9 and A10 in FIG. 12). In addition, in the Step E12, the controller 15 determines the end of the image formation job. If the last page is not detected, the procedure returns to Step E11 and the above processes are repeated. If the last page is detected, the procedure goes to Step E13.

In Step E13, memory control is divided in accordance with first power-on correction mode or normal correction processing of color misregistration. In the first power-on correction mode, in the case where the color registration adjustment value is obtained, the procedure goes to Step E14 and the color registration adjustment value is stored in the memory 401. In this case, as is the case in the first embodiment, the color registration adjustment value obtained by carrying out the first power-on mode is stored in memory #1. The default adjustment value at the time of shipment is stored in memory #2. The color registration adjustment value used when the normal operation mode is carried out is also stored in memory #1. Subsequently, the procedure goes to Step E21.

In Step E9, in the case where the QP button 61 is not pressed even after the predetermined time has elapsed, the correction process of color misregistration is assigned the last rank among the correction processes and the procedure goes to Step E16 and correction processing of color misregistration is performed independently (See step A12 in FIG. 12). Subsequently, the procedure moves to Step E17 and the end of the correction processing of color misregistration is determined. When the correction processing of color misregistration ends, the procedure goes to Step E18 and the color registration adjustment value is stored in memory #1.

After this, the procedure goes to Step E19 and monochrome image formation job is performed (See Step A10 in FIG. 12). In addition, Step E20, the controller 15 determines the end of image formation job. If the last page is not detected, the process returns to Step E19 and the foregoing processing is repeated. If the last page is detected, the procedure goes to Step E21. In Step E21, color or monochrome copying and printing processing is performed after waiting for the image formation job request for the normal operation in the subroutine shown in FIG. 13.

Subsequently, the procedure goes to Step E22 and the end is determined. For example, the controller 15 detects the power-off information and goes to the power saving mode. When the power source switch 83 is turned off, the power-off information is output to the controller 15 from the power source controller 85, and the normal operation mode is cancelled and then the power saving mode is entered. In the power saving mode, the power supply to the fixing unit 17 of the image forming section 80 for example is cut off and power required for minimum operation is supplied to other load circuits 90 such as the clock function, the CPU function, the monitor display function, the communication function (facsimile) and the like.

If the power-off information is not detected, in the Step E23, the controller 15 set the image forming section 80 to the standby mode and the procedure returns to Step E13. In the standby mode, power required for memory rewriting in memory control is ensured and the power saving control signal S80 is output to the image forming section 80 from the power source control section 85. In the image forming section 80, the fixing temperature of the fixing unit 17 is reduced based on the power saving control signal S80, and control is thereby performed so as to reduce power consumption.

In Step E13 above, the controller 15 which set the standby mode divides memory control in accordance with first power-on correction mode or normal correction processing of color misregistration. In the case where the color registration adjustment value is obtained in the first power-on correction mode, the procedure goes to Step E15 and the color registration adjustment value is stored in the memory 401. As is the case in the first embodiment, the color registration adjustment value used for the normal operation mode is stored in memory #1. Subsequently, the procedure goes to Step E21 and the image formation job is awaited in the subroutine. As a result, in the first power-on correction mode that is carried out at the same time as power-on, correction processing of color misregistration including the QP mode can be realized.

In this manner, the color copier 300 of the third embodiment comprises a QP button 61, and only in the case where the QP mode is set by the user, at the point where warm-up and correction processing of process other than color registration correction is complete, the monochrome copy or print job is accepted and the printing operation based on the color registration adjustment data stored in memory 401 and 402 begins.

Thus, even in the case where the user requests a monochrome image formation job, if the PQP mode is not selected, after the first power-on mode ends, the print operations for the monochrome image formation job can start. The monochrome images of high image quality from the image formation system which has been subjected to correction processing of color misregistration by the first power-on correction mode can be printed out.

According to the image forming apparatus of one embodiment, when the presence of power-on is detected and the fixing temperature is detected, after process correction mode is set, the controller sets the priority level for performing the correction processing of color misregistration to be lower than that of correction process of processing other than correction processing of color misregistration.

Due to this configuration, correction process of processing other than correction processing of color misregistration ends and finally correction processing of color misregistration is carried out. In addition, real time correction processing mode is carried out in parallel with the image formation job and the wait time for the user can be shortened.

According to the image formation apparatus of another embodiment, the controller includes the elapse time from the previous power-off to the corresponding power-on and/or the elapse time from transition to the standby mode to the corresponding power-on in the setting determination conditions in setting the process correction mode, and thus after the correction processing of color misregistration, normal image formation mode can be carried out based on elapse time (by changing priority level).

According to the image formation apparatus of still another embodiment, the image formation job is received after correction process of processing other than correction processing of color misregistration is carried out, and thus the wait time for the user is shortened.

According to the image formation apparatus of one embodiment, real time correction mode is carried out in parallel with the image formation job and thus the correction processing of color misregistration can be carried out using the time for carrying out the image formation job.

According to the image formation apparatus of another embodiment, the real time correction mode can be carried out by reading the adjustment value from the memory section when the process correction mode is carried out.

According to the image formation apparatus of still another embodiment, the adjustment value for correction processing of color misregistration obtained when the previous process correction mode is carried out or the default correction value obtained in the manufacturing adjustment step are read from the memory means and the real time correction mode is carried out.

According to the image formation apparatus of one embodiment, by performing only monochrome copying operations, color output image deterioration can be avoided until the first real time correction mode can be carried out.

According to the image formation apparatus of another embodiment, a selector for selecting a quick image formation mode is provided and thus emphasis on image quality or priority on image creation may be selected in accordance to the length of wait time.

According to the image formation apparatus of still embodiment, if the quick image formation mode is not selected, or in other words, when the mode which emphasizes image quality is selected, high quality color images can be obtained.

According to the image formation apparatus of one embodiment, when the quick image formation mode is not selected, or in other words, even when the mode which emphasizes image quality is selected, monochrome images are preferentially created and the wait time is reduced.

According to the image formation apparatus of another embodiment, an image area and a non-image area is provided in the primary scanning direction and a mark image for color misregistration correction is formed on an image carrier in which the exposable width in the primary scanning direction is set to be wider than the maximum width of the transfer paper, and real time correction mode is thereby carried out.

What is claimed is:

1. An image forming apparatus which performs at least a correction processing of color misregistration in an image formation system and a correction processing comprising an image density adjustment, the image forming apparatus having a process correction mode wherein when a temperature of a fixing device in the image formation system in a power-on state is equal to or less than a predetermined value, the image forming apparatus being configured to increase a temperature of the fixing device to the predetermined value, such that the image density adjustment can be performed, the image forming apparatus comprising:

(a) a first detector which detects presence of the power-on state for the apparatus;

(b) a second detector which detects a fixing temperature in the fixing device; and (c) a controller which sets the process correction mode based on power-on information output from the first detector and fixing temperature information output from the second detector, and sets a priority level for performing the correction processing of the color misregistration to be lower than the correction processing of the image density adjustment.

2. The image forming apparatus of claim 1, wherein the controller sets the process correction mode, by including an elapse time from a previous power-off to a corresponding power-on or an elapse time from transition to a standby mode to a corresponding power-on in a setting determination condition, where the standby mode represents an operation of suppressing a power consumption in the image forming system and of making an image formation job to stand by.

3. The image forming apparatus of claim 1, wherein the controller receives the image formation job after carrying out the correction processing of the image density adjustment according to the process correction mode.

4. The image forming apparatus of claim 3, wherein the controller carries out a real time correction mode in parallel with the image formation job which has been received after carrying out the process correction mode, where the real time correction mode represents an operation of performing the correction processing of color misregistration in parallel with a printing operation relating to the image formation job.

5. The image forming apparatus of claim 4, further comprising a memory section which stores an adjustment value when the process correction mode is carried out, that is obtained by the real time correction mode in parallel with the image formation job.

6. The image forming apparatus of claim 5, wherein the memory section stores an adjustment value for correction of a color misregistration obtained by a process correction mode carried out in a previous day, or a default correction value obtained in a manufacturing adjustment step.

7. The image forming apparatus of claim 1, wherein the controller receives only a monochrome image formation job after the correction processing comprising the image density adjustment is completed, and thereafter starts a printing operation relating to the monochrome image formation job until the correction processing of color misregistration is carried out independently.

8. The image forming apparatus of claim 1, further comprising a selector which selects a quick image formation mode to carry out the image formation job, and the controller receives the image formation job after the image density adjustment is completed.

9. The image forming apparatus of claim 8, wherein when the quick image formation mode is not selected, the controller receives the image formation job after all of the correction processing including the correction processing of color misregistration is completed, thereafter starts a printing operation relating to the image formation job.

10. The image forming apparatus of claim 8, wherein when the quick image formation mode is not selected, the controller receives a monochrome image formation job after all of the correction processing including the correction processing of color misregistration is completed, thereafter starts a printing operation relating to the image formation job.

11. The image forming apparatus of claim 1, wherein the image forming system comprises an image carrier having an image area on which an image is formed to be transferred onto a transfer sheet and a non-image area on which a registration mark image is formed for color misregistration correction, that are provided in a primary scanning direction, and an exposable width of the image carrier in the primary scanning direction is set to be wider than a maximum width of the transfer sheet.

* * * * *